US007445256B2

(12) United States Patent
Gotou et al.

(10) Patent No.: US 7,445,256 B2
(45) Date of Patent: Nov. 4, 2008

(54) AUTOMOTIVE DOOR LATCH DEVICE

(75) Inventors: Shingo Gotou, Atsugi (JP); Junichi Shimada, Yokohama (JP); Hirotsugu Takai, Yokohama (JP); Takashi Ogawa, Ota (JP)

(73) Assignee: Ohi Seisakusho Co., Ltd., Kanawgawa (JP)

( * ) Notice: Subject to any disclaimer, the term of this patent is extended or adjusted under 35 U.S.C. 154(b) by 0 days.

(21) Appl. No.: 11/188,883

(22) Filed: Jul. 26, 2005

(65) Prior Publication Data

US 2006/0087129 A1 Apr. 27, 2006

(30) Foreign Application Priority Data

Jul. 27, 2004 (JP) ..... 2004-218567

(51) Int. Cl.
*E05C 3/06* (2006.01)
*E05C 3/00* (2006.01)

(52) U.S. Cl. ..... 292/216; 292/201; 292/DIG. 23

(58) Field of Classification Search ..... 292/216, 292/201, DIG. 23
See application file for complete search history.

(56) References Cited

U.S. PATENT DOCUMENTS

| | | | | |
|---|---|---|---|---|
| 4,575,138 | A * | 3/1986 | Nakamura et al. | 292/216 |
| 5,000,495 | A * | 3/1991 | Wolfgang et al. | 292/216 |
| 6,007,118 | A * | 12/1999 | Arabia et al. | 292/216 |
| 6,848,286 | B2 * | 2/2005 | Dimig | 70/277 |
| 6,879,058 | B2 * | 4/2005 | Lorenz et al. | 307/10.1 |
| 6,883,839 | B2 * | 4/2005 | Belmond et al. | 292/201 |
| 2002/0171250 | A1 | 11/2002 | Kobayashi et al. | |

FOREIGN PATENT DOCUMENTS

| | | | |
|---|---|---|---|
| EP | 0 894 924 | A | 2/1999 |
| EP | 1 158 125 | A | 11/2001 |
| EP | 1 350 913 | A | 10/2003 |
| JP | 2002-81246 | A | 3/2002 |
| JP | 2002 081247 | A | 3/2002 |
| JP | 2002-81247 | A | 3/2002 |
| JP | 2002-339625 | A | 11/2002 |
| WO | WO01/63077 | A | 8/2001 |

* cited by examiner

*Primary Examiner*—Carlos Lugo
*Assistant Examiner*—Kristina R Fulton
(74) *Attorney, Agent, or Firm*—Sughrue Mion, PLLC

(57) ABSTRACT

An actuating assembly for an automotive door latch device comprises a housing that operatively installs therein basic elements that are commonly used in an override function unit and a child proof function unit. The override function unit has a function wherein a manipulation of an inside door handle induces cancellation of the engaged condition of the latch means irrespective of the condition of the locking/unlocking means. The child proof function unit has a function wherein the manipulation of the inside door handle is made inoperative irrespective of the condition of the locking/unlocking means, thereby to make the cancellation of the engaged condition of the latch means impossible. The actuating assembly further comprises a cover that is coupled to the housing and holds thereon a selected element that is exclusively used in either one of the override function unit and the child proof function unit.

6 Claims, 23 Drawing Sheets

AUTOMOTIVE DOOR LATCH DEVICE

BACKGROUND OF THE INVENTION

1. Field of the Invention

The present invention relates in general to automotive door latch devices, and more particularly to automotive door latch devices of a type that comprises a striker that is fixed to a vehicle body, a latch assembly that is mounted to a door and includes a latch means that is engageable with the striker and a locking/unlocking means that causes the latch means to switch between an unlocked condition wherein an engaged condition of the latch means is unlocked and a locked condition wherein the engaged condition of the latch means is locked, and an actuating assembly that is connected to the latch assembly to actuate the latch means and the locking/unlocking means.

2. Description of the Related Art

Hitherto, various types of automotive door latch devices have been proposed and put into practical use particularly in the field of wheeled motor vehicles.

Japanese Laid-open Patent Application (Tokkai) 2002-339625 shows a door latch device of override type in which upon manipulation of an inside door handle, the engagement between a latch plate and a striker is cancelled irrespective of the position of the latch plate. Japanese Laid-open Patent Application (Tokkai) 2002-81246 shows a door latch device of normal type that has not the above-mentioned override function, and Japanese Laid-open Patent Application (Tokkai) 2002-81247 shows a door latch device of child proof type in which manipulation of the inside door handle is inoperative irrespective of the position of the latch plate, thereby making cancellation of a locked condition of the latch plate impossible.

SUMMARY OF THE INVENTION

In the above-mentioned known door latch devices, there are employed various basic elements that are commonly used in the different types of door latch devices, which are for example a knob lever that is linked to a lock knob mounted on an inside surface of a door, an inside lever that is connected to an operation handle mounted on the inside portion of the door, a transmission member that transmits the movement of the knob lever to the lock plate. Besides the above-mentioned basis elements, each type of the door latch devices employs a selected element that is exclusively used in each type, which is for example an override lever in case of the override type door latch device, and a child proof lever in case of the child proof type door latch device.

However, in the above-mentioned known door latch devices, common usage of the basic elements and effective arrangement of the selected elements have been hitherto given little thought, which has induced increase in cost of the door latch devices.

Accordingly, an object of the present invention is to provide an automotive door latch device that is constructed to make common usage of the latch assembly and effective arrangement of selected elements possible in both the override type and the child proof type.

In accordance with the present invention, there is provided an automotive door latch device which comprises a striker fixed to a body of the vehicle; a latch assembly mounted to a door of the vehicle, the latch assembly including a latch means that is engageable with the striker and a locking/unlocking means that causes the latch means to switch between an unlocked condition wherein an engaged condition of the latch means is unlocked and a locked condition wherein the engaged condition of the latch means is locked; and an actuating assembly connected to the latch assembly to actuate the latch means and the locking/unlocking means, wherein the actuating assembly comprises a housing that operatively installs therein basic elements that are commonly used in an override function unit and a child proof function unit, the override function unit having a function wherein a manipulation of an inside door handle induces cancellation of the engaged condition of the latch means irrespective of the condition of the locking/unlocking means, the child proof function unit having a function wherein the manipulation of the inside door handle is made inoperative irrespective of the condition of the locking/unlocking means, thereby to make the cancellation of the engaged condition of the latch means impossible; and a cover that is coupled to the housing and holds thereon a selected element that is exclusively used in either one of the override function unit and the child proof function unit.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

In the following, first and second embodiments 100 and 200 of the present invention will be described in detail with reference to the accompanying drawings, in which the first embodiment 100 is an override type door latch device and the second embodiment 200 is a child proof type door latch device.

For ease of understanding, various directional terms, such as, right, left, upper, lower, rightward and the like are used in the following description. However, such terms are to be understood with respect to only a drawing or drawings on which a corresponding part or portion is shown. Throughout the specification, substantially same parts are denoted by the same numerals.

Referring to FIGS. 1 to 24 of the drawings, there is shown an override type automotive door latch device 100 which is a first embodiment of the present invention.

The door latch device 100 is of a type mounted on a left-front door of an associated motor vehicle. More specifically, the door latch device 100 is mounted on a rear (or free) end portion of the left-front door of which front end is hinged to a vehicle body.

Figure 2:
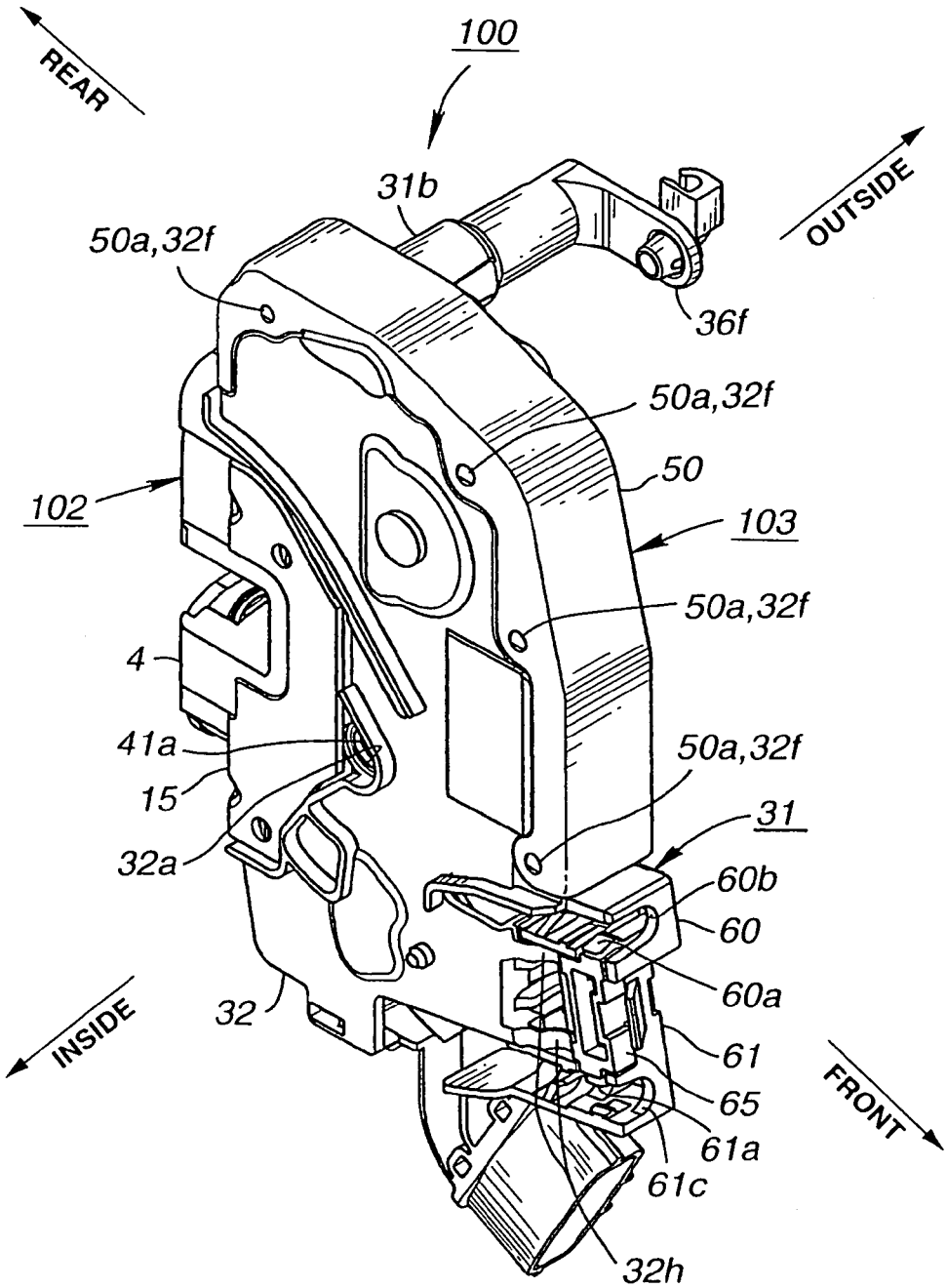
FIG. 2 is a perspective view of the door latch device of the first embodiment.

As is seen from FIG. 2, the door latch device 100 generally comprises a striker "ST" that is secured to a vehicle body (not shown), a latch assembly 102 that is secured by bolts or the like to the rear part of an associated door and an actuating assembly 103 that actuates the latch assembly 102.

Figure 19:
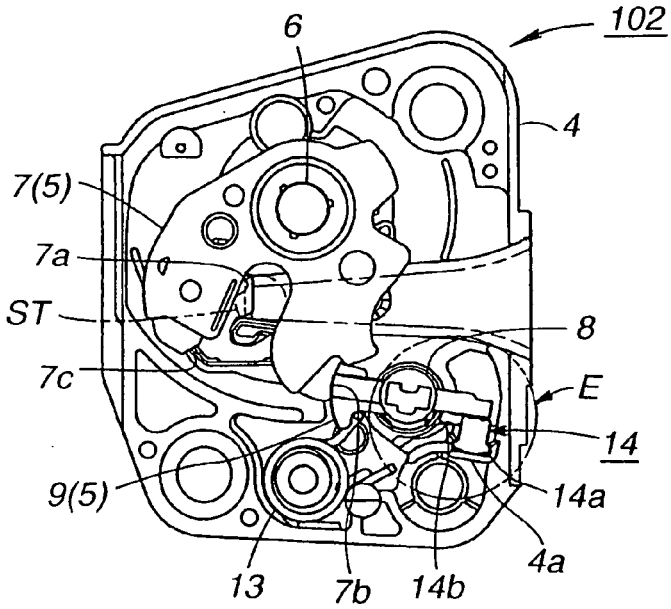
FIG. 19 is an inside view of a latch unit.

The latch assembly 102 is of a commonly applicable type, and comprises as is seen from FIG. 19, a plastic case 4, a latch unit 5 installed in the case 4 and engageable with the striker "ST" upon closing of the door. It is to be noted that for showing the interior of the case 4, a cover plate 16 (see FIG. 1) that covers an open side of the case 4 is not shown in FIG. 19.

As is seen from FIG. 19, the latch unit 5 comprises a latch plate 7 that is pivotally installed in the case 4 through a pivot shaft 6 and engageable with the striker "ST" through an engaging recess 7*a* thereof, and a locking plate 9 that is pivotally installed in the case 4 through a pivot shaft 8 and engageable with pawl portions 7*b* and 7*c* formed on the latch plate 7. Upon engagement with the pawl portions 7*b* and 7*c*, pivoting of the latch plate 7 in an open direction, that is, in a counterclockwise direction in FIG. 19 is suppressed. The latch plate 7 is biased to turn in a counterclockwise direction in FIG. 19 by a coil spring 12 (see FIG. 1) that is disposed about the pivot shaft 6.

When the door is kept closed, the latch plate 7 is in a close position as shown in FIG. 19 wherein the striker "ST" is caught by the engaging recess 7*a* of the latch plate 7. While, when the door is kept opened, the latch plate 7 is in an open position that is away from the close position by about 90 degrees in angle in a counterclockwise direction thereby releasing the striker "ST". Upon closing of the door, the striker "ST" is led into the engaging recess 7*a* of the latch plate 7 turning the latch plate 7 to the close position and finally the latch plate 7 is locked at the close position by the locking plate 9, as will be clarified from the following.

During turning of the latch plate 7 from the open position to the close position, the locking plate 9 is turned counterclockwise from the position (viz., close position) of FIG. 19 at first against a force of a biasing spring 13 and thereafter, that is, when the latch plate 7 is sufficiently turned toward the close position, the locking plate 9 is turned back in a clockwise direction due to the force of the biasing spring 13 and brought into engagement with one of the two pawl portions 7*b* and 7*c* of the latch plate 7. Upon this, the turning of the latch plate 7 toward the open position is suppressed. That is, when the locking plate 9 is in engagement with the pawl portion 7*b*, as shown in FIG. 19, the latch plate 7 is fully locked by the locking plate 9 thereby assuming a full-locked position, and when the locking plate 9 is in engagement with the other pawl portion 7*c*, the latch plate 7 is half or incompletely locked by the locking plate 9 thereby assuming a half-locked position.

When, due to manipulation of an outside door handle (not shown) mounted on an outside surface of the door, an after-mentioned open lever 11 is pivoted to its unlocking position, the locking plate 9 is turned counterclockwise in FIG. 19 separating from the pawl portion 7*b* or 7*c* thereby releasing the latch plate 7. With this, the latch plate 7 is permitted to release the striker "ST", and thus permit opening the door when the door is pulled outward with a certain force.

As is seen from FIG. 19, near the locking plate 9, there is located a stopper 14 of rubber that is fixed to the case 4 for stopping excessive pivoting of the locking plate 9.

Figure 22:
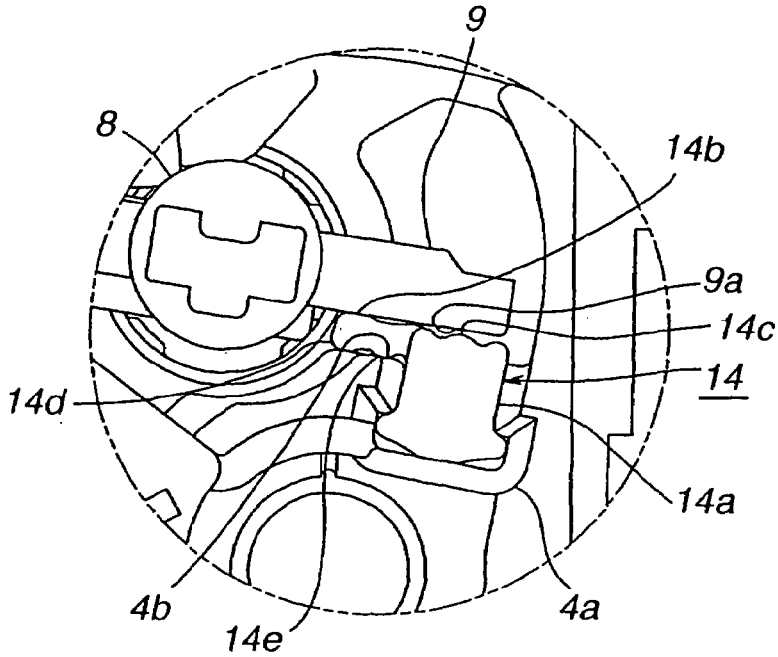
FIG. 22 is an enlarged view of a portion indicated by the arrow "E" in FIG. 19.
Figure 23:
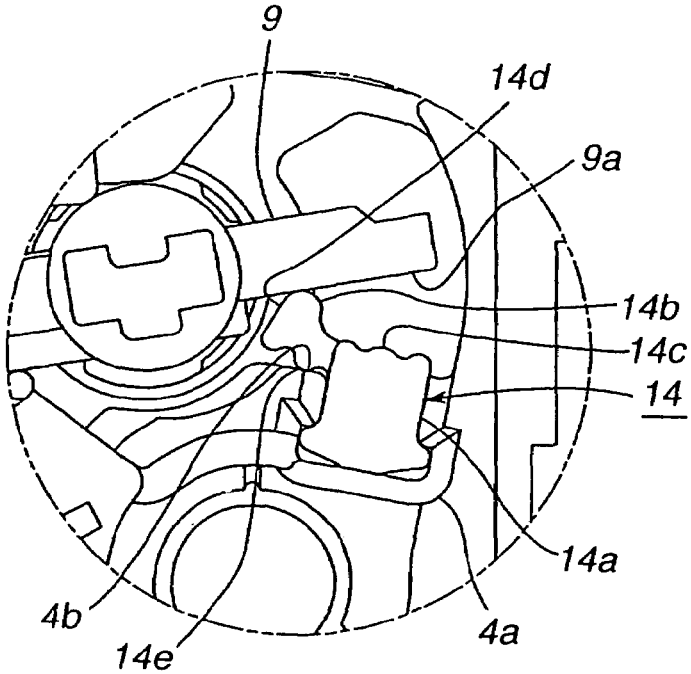
FIG. 23 is a view similar to FIG. 22, but showing a condition wherein a locking plate is in the middle of operation.
Figure 24:
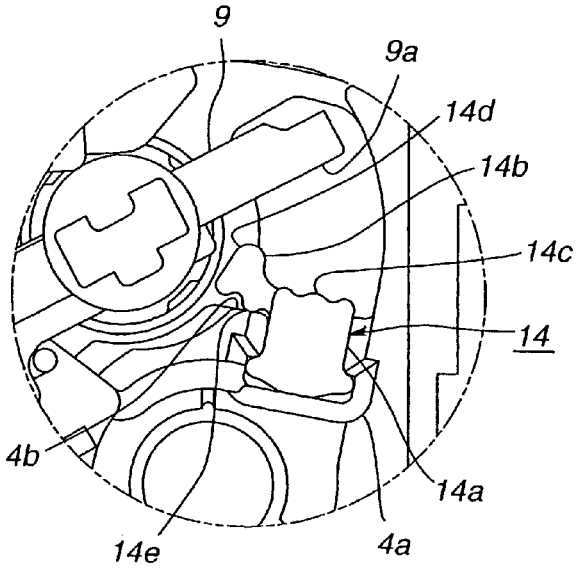
FIG. 24 is a view similar to FIG. 22, but showing a condition wherein the locking plate is in an unlocking position.

As is seen from FIGS. 22 to 24, the stopper 14 is generally in a cubic shape and comprises a base portion 14*a* that is press-fitted in a generally U-shaped catch portion 4*a* provided by the case 4. The base portion 14*a* is formed with a corrugated upper surface 14*c* against which a right arm portion of the locking plate 9 is able to abut.

As is seen from FIG. 23, the stopper 14 is integrally formed with a lip portion 14*b* that extends obliquely upward from a left wall of the base portion 14*a*. As is seen from this drawing, the lip portion 14*b* has a hammer like head portion 14*d* and at a middle portion thereof a downward projection 14*e*.

That is, when, upon movement of the latch plate 7 from the open position to the close position, the locking plate 9 is turned from the unlocking position (viz., the position shown in FIG. 24) the locking position due to the force of the biasing spring 13, a lower surface 9*a* of the right arm portion of the locking plate 9 is brought into abutment with an upper part of the hammer like head portion 14*d*, and thus, the lip portion 14*b* is elastically bent downward having the downward projection 14*e* held by a supporting portion 4*b* provided by the case 4. When, thereafter, the lip portion 14*b* is bent by a predetermined degree, the head portion 14*d* and the downward projection 14*e* are elastically compressed against the supporting portion 4*b*. With this, as is seen from FIG. 22, the locking plate 9 is stopped at its locking position having the lower surface 9*a* thereof pressed against both the corrugated upper surface 14*c* of the base portion 14*a* and the hammer like head portion 14*d* of the lip portion 14*b* that is kept biased upward. That is, undesired shock that would be produced when the right arm portion of the locking plate 9 is brought into contact with the stopper 14 is softly absorbed or damped by the lip portion 14*b*.

Figure 20:
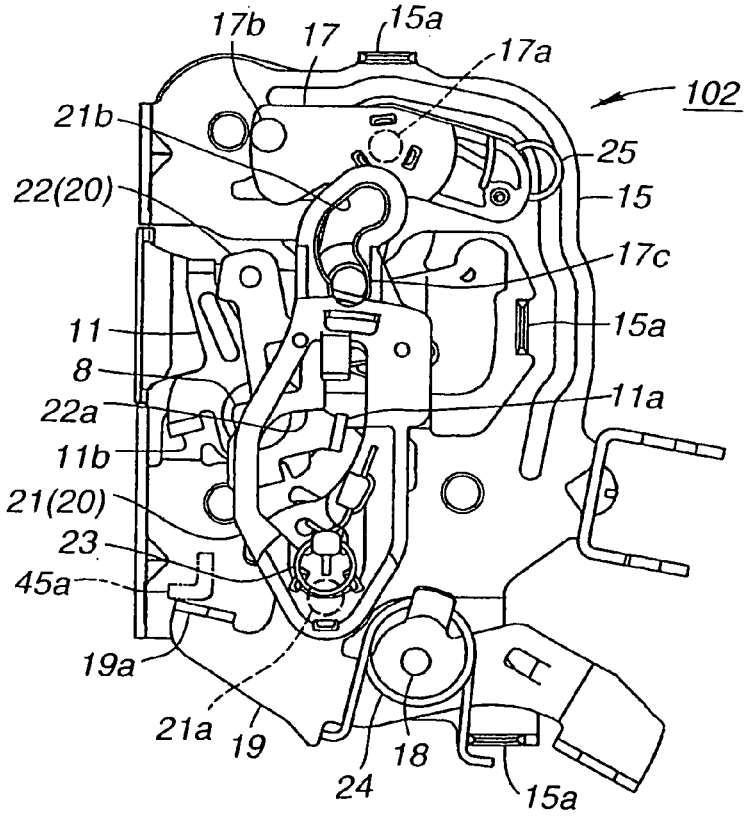
FIG. 20 is a front view of the latch unit in a locked condition.
Figure 21:
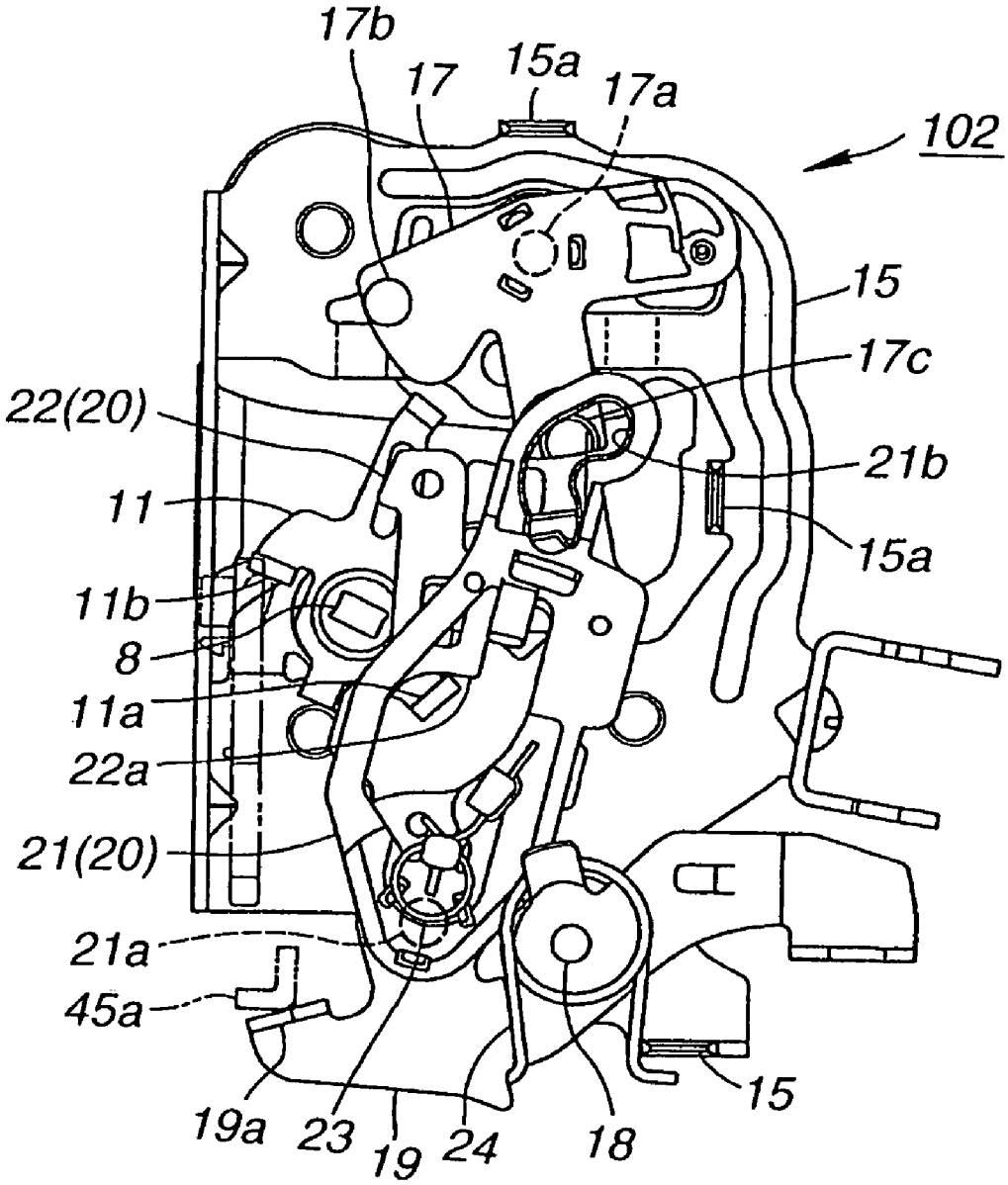
FIG. 21 is view similar to FIG. 20, but showing the latch unit in an unlocked condition.

FIGS. 20 and 21 show a front view of the latch assembly 102. As will be understood from these drawings and FIG. 1, to a front surface side of the case 4, there is secured a metallic base plate 15.

As is seen from FIG. 20, to the metallic base plate 15, there is pivotally connected the open lever 11 through the pivot shaft 8, and thus the open lever 11 and the locking plate 9 are pivotal together like a single unit. Furthermore, to the metallic base plate 15, there are mounted a locking/unlocking lever 17 that is pivotally connected thereto through its shaft portion 17*a* and constitutes part of a locking/unlocking means, an outside lever 19 that is pivotally connected thereto through a shaft 18 and linked to an outside door handle (not shown), and a sub-lever unit 20 that is arranged between the locking/unlocking lever 17 and the outside lever 19 and constitute the other part of the locking/unlocking means.

The locking/unlocking lever 17 is actuated by a lock knob (not shown) mounted on an inside surface of the door, an after-mentioned electric motor 33 installed in the actuating assembly 103 and/or a key cylinder (not shown) arranged on an outside surface of the door. That is, upon actuation, the locking/unlocking lever 17 is forced to pivot about the axis of the shaft portion 17*a* between a locking position as shown in FIG. 20 and an unlocking position as shown in FIG. 21. As will be understood when comparing these two drawings, viz., FIGS. 20 and 21, the unlocking position of FIG. 21 is an angular position away from the locking position of FIG. 20 by a predetermined angle in a counterclockwise direction. Due to a force of a coil spring 25 (see FIG. 1) arranged between the locking/unlocking lever 17 and the base plate 15, the locking/unlocking lever 17 can be pivoted to the locking or unlocking position in a snap action manner and held in such position.

As is seen from FIG. 20, the locking/unlocking lever 17 is formed with a projection 17*b* that projects in this side in the drawing. As will be described in detail hereinafter, once the actuating assembly 103 is properly mounted to the latch assembly 102, the projection 17*b* is brought into engagement with an after-mentioned transmission lever 46 of the actuating assembly 103 to achieve a synchronous movement therebetween.

Figure 1:
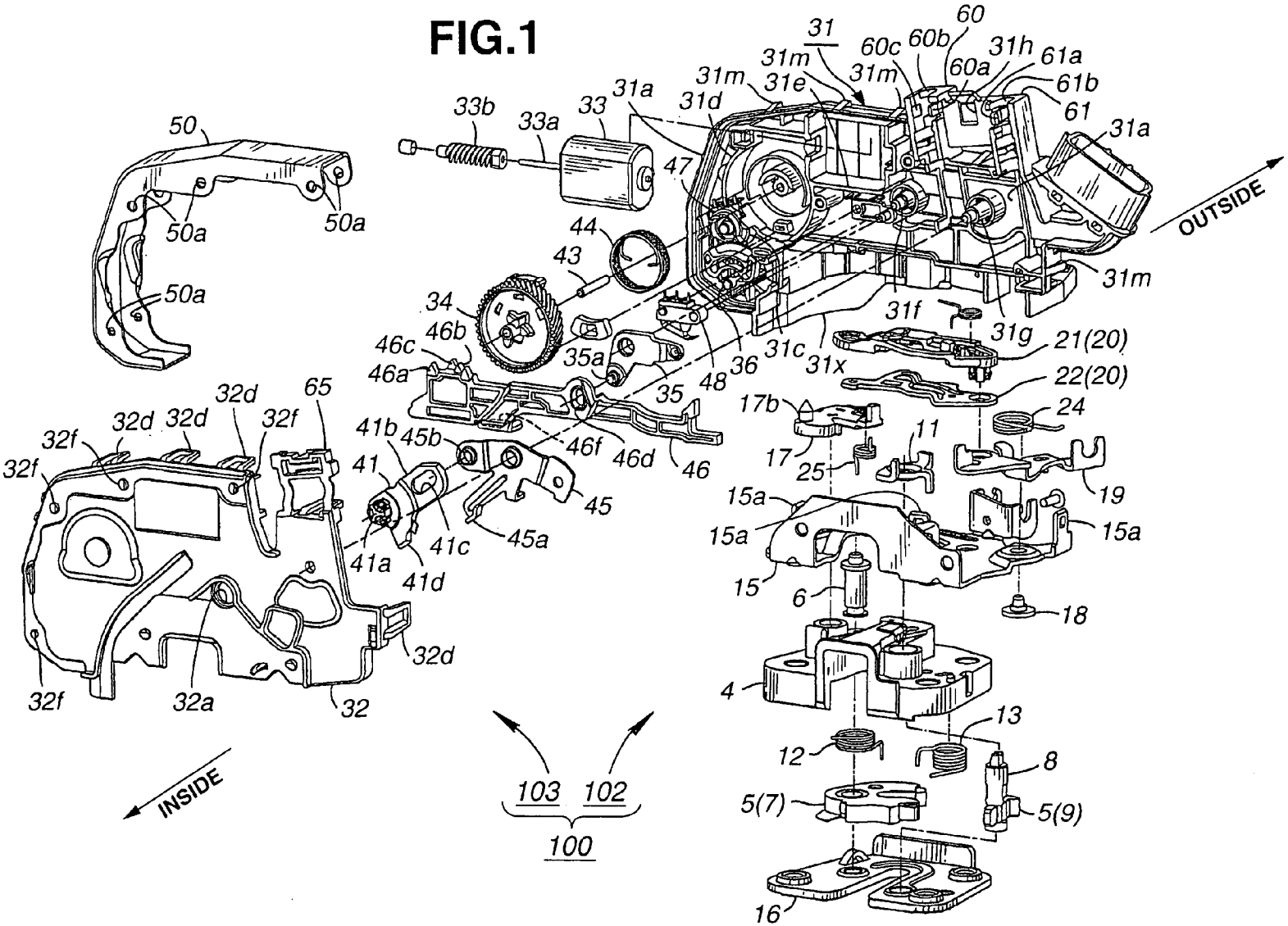
FIG. 1 is an exploded view of an override type door latch device which is a first embodiment of the present invention.

As is seen from FIG. 1, the sub-lever unit 20 comprises a first lever member 21 and a second lever member 22 which are separate members. As is seen from FIG. 20, the first lever member 21 has a lower end that is pivotally connected through a connecting shaft 21*a* to a free end portion of the outside lever 19, and has an upper end that has a bent slot 21*b* slidably engaged with a projection 17*c* provided on a lower end portion of the locking/unlocking lever 17. The second lever member 22 has a lower end portion that is pivotally connected through the connecting shaft 21*a* to the lower end of the first lever member 21. Due to a force of a coil spring 23 arranged between the first and second lever members 21 and 22, the second lever member 22 is biased in a clockwise direction about the connecting shaft 21*a* in FIGS. 20 and 21. It is to be noted that as is seen from FIGS. 20 and 21, due to the biasing force of the coil spring 23, the first and second lever members 21 and 22 can move together like a single unit keeping their relative positioning.

When the locking/unlocking lever 17 is in the locking position, the sub-lever unit 20 (viz., first and second lever members 21 and 22) is in its locking position as shown in FIG. 20, while when the locking/unlocking lever 17 is pivoted from the locking position to the unlocking position, the sub-lever unit 20 is pivoted in a clockwise direction to its unlocking position about the connecting shaft 21*a*.

In the illustrated embodiment, the locking/unlocking means is constructed to have the locking/unlocking lever 17 and the sub-lever unit 20. However, in the present invention, the locking/unlocking means is not limited to such construction. That is, for example, the sub-lever unit 20 may comprise first and second lever members 21 and 22 which are integral to each other.

In the following, a basic operation of the door latch device 100 will be described with reference to the drawings.

It is to be noted that the locking condition of the locking/unlocking means is a condition wherein the locking/unlocking lever 17 and the sub-lever unit 20 assume their locking positions, while, the unlocking condition of the locking/unlocking means is a condition wherein the locking/unlocking lever 17 and the sub-lever unit 20 assume their unlocking positions.

For ease of understanding, the following description on the basing operation will be commenced with respect to a condition wherein the locking/unlocking means is in the unlocking condition.

When now the outside door handle (not shown) is manipulated for the purpose of opening the associated door, the outside lever 19 (see FIG. 20) is pivoted from its standby position of FIG. 20 to an unlocking position of FIG. 21 against a force of a biasing coil spring 24 thereby to move the sub-lever unit 20 downward. Upon this, a canceling portion 22*a* of the second lever member 22 is brought into contact with a first engaging portion 11*a* of the open lever 11 thereby to turn the open lever 11 toward its unlocking position. Upon this, the locking plate 9 is pivoted toward the unlocking position together with the open lever 11 against the force of the spring 13 thereby to be released from the pawl portion 7*b* (or 7*c*) of the latch plate 7. With this, the latch unit 5 becomes free and thus, the door is permitted to open when the door is pulled outward with a certain force.

While, when, as is seen from FIG. 20, the locking/unlocking means is kept in its locking condition, manipulation of the outside door handle for the purpose of opening the door does not permit opening of the door for the reason that will be described in the following.

That is, when, due to the manipulation of the outside door handle, the sub-lever unit 20 is moved downward, the canceling portion 22*a* of the second lever member 22 strikes air against the first engaging portion 11*a*, and thus, the locking plate 9 is not turned toward the unlocking position.

In the following, the actuating assembly 103 will be described in detail with reference to the drawings.

As is seen from FIGS. 2 to 6, the actuating assembly 103 is mounted to the latch assembly 102 and is a commonly applicable type, and comprises a plastic housing 31 to which after-mentioned basic elements that are commonly used in the above-mentioned latch assembly 102 are mounted and a plastic cover 32 that is connected to the housing 31 and has after-mentioned selected elements mounted thereto.

The basic elements are the elements that are employed in a normal type door latch device that is free of an override function and a child proof function. The basic elements are for example a knob lever 35 that is linked to the lock knob mounted on the inside surface of the door, an inside lever 45 that is linked to an inside door handle (not shown) and the transmission lever 46 that transmits the movement of the knob lever 35 to the locking/unlocking means of the latch assembly 102.

In the actuating assembly 103 for the door latch device 100 mounted on the left front door of the vehicle, a key lever 36 that is linked to the key cylinder mounted on the outside surface of the door is added as one of the basic elements. In the electric type that actuates the locking/unlocking means with an aid of an electric power, the electric motor 33, a worm wheel 34, a motor shaft 33*a*, a worm 33*b* that constitutes part of a speed reduction mechanism and a rotary switch 47 that senses operation of the key cylinder are added as the basic elements. In the override type, an override lever 41 is added as one of the basic elements, that is able to cancel the engaged condition of the latch unit 5 in synchronization with an operation of the basic element based on a manipulation of the inside door handle.

While, as will be described in detail hereinafter, in the child proof type that is the second embodiment 200 of the present invention, a child proof lever 70 is added as one of the basic elements, that makes the operation of the inside lever 45 (which is induced by the operation of the inside door handle) inoperative thereby to make cancellation of the engaged condition of the latch unit 5 inoperative.

Referring back to the override type door latch device 100 of the first embodiment, the door latch device 100 is of a type that is to be mounted on a left-front door and has both an override function and electric power function. Thus, the key lever 36, the electric motor 33, the worm wheel 34 and the rotary switch 47 are added as the basic elements. While, the override lever 41 is added as the selected element.

Figure 3:
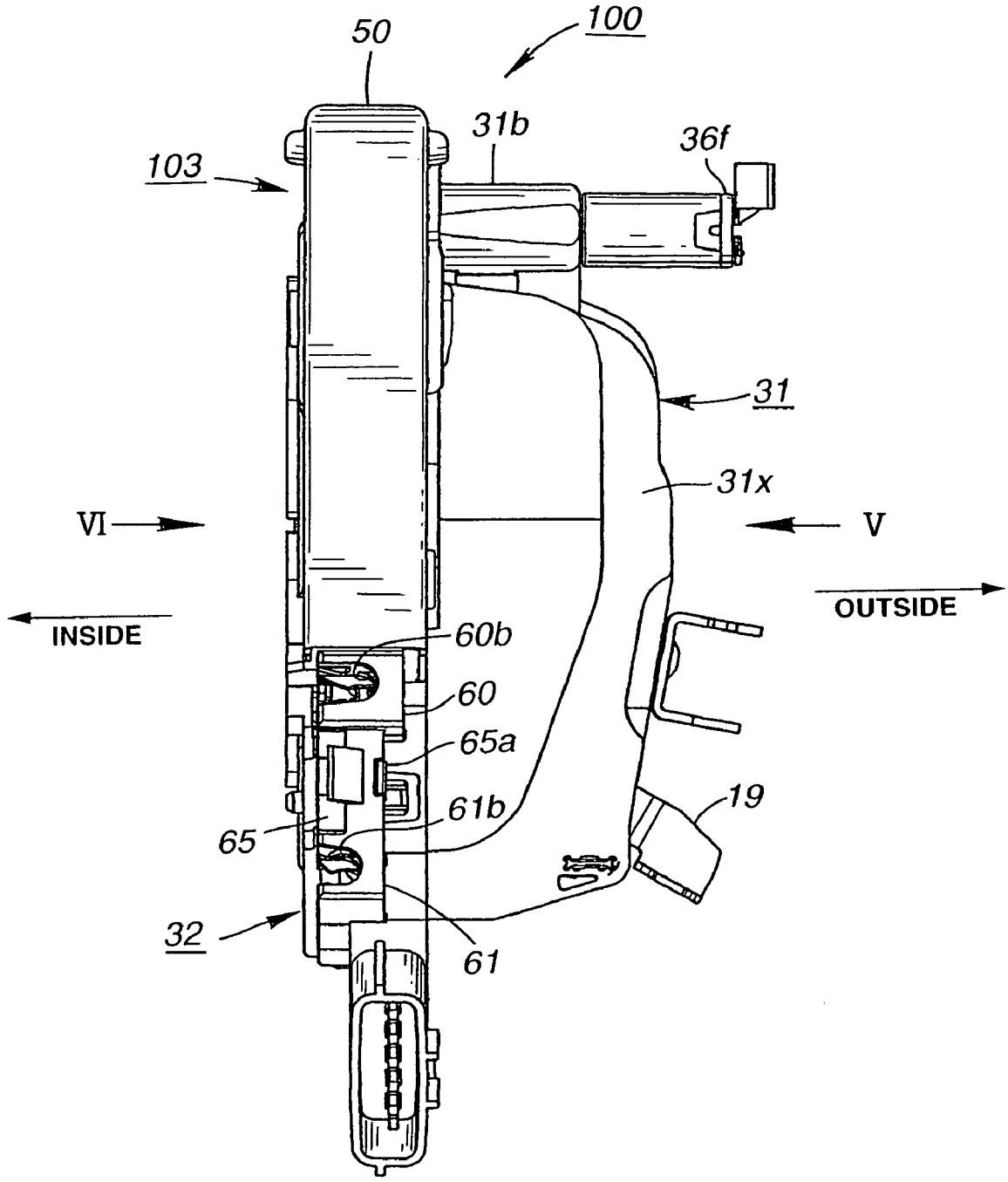
FIG. 3 is a front view of the door latch device of the first embodiment.
Figure 4:
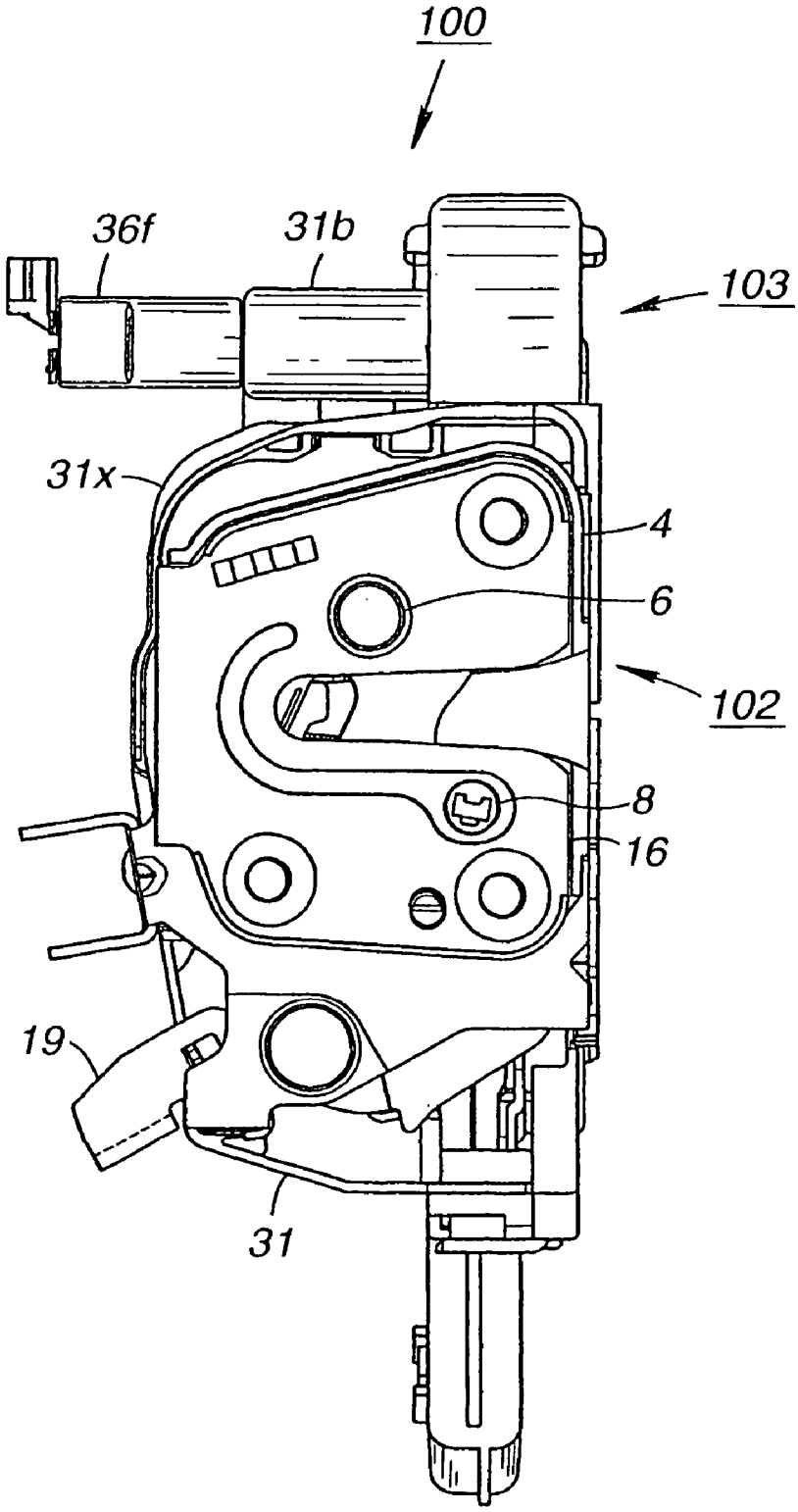
FIG. 4 is a rear view of the door latch device of the first embodiment.
Figure 5:
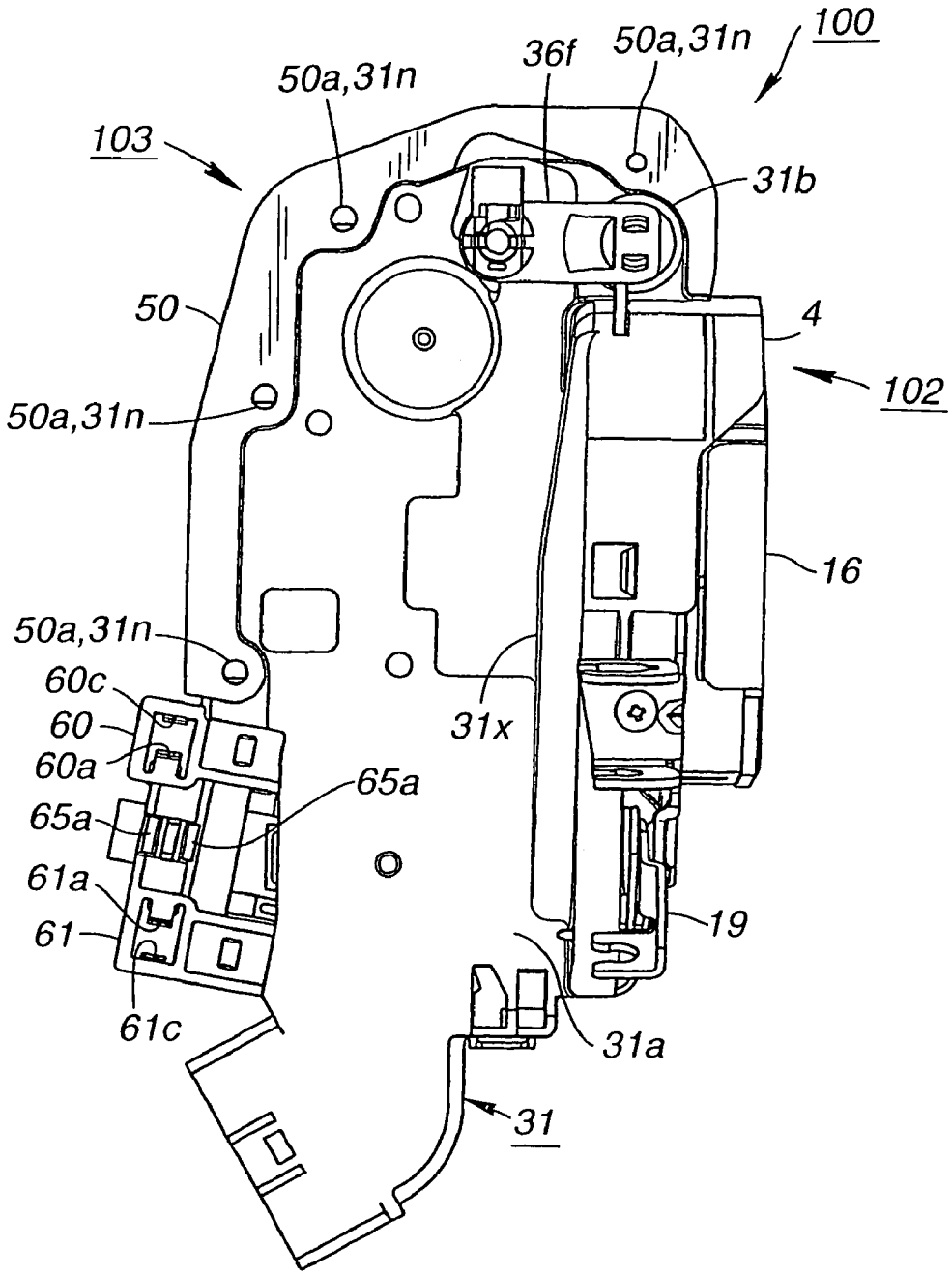
FIG. 5 is a right side view of the door latch device of the first embodiment, that is taken from the direction of the arrow "V" of FIG. 3.

As is understood from FIGS. 1, 2 and 3, the plastic housing 31 is arranged generally perpendicular to a front surface of the latch assembly 102 and has a part containing recess 31*a* in which the above-mentioned basic elements are installed. As is seen from FIGS. 1 and 3, from a rear end of the part containing recess 31*a*, there extends a cover portion 31*x* that faces the front surface of the latch assembly 102 and covers the locking/unlocking means.

Figure 6:
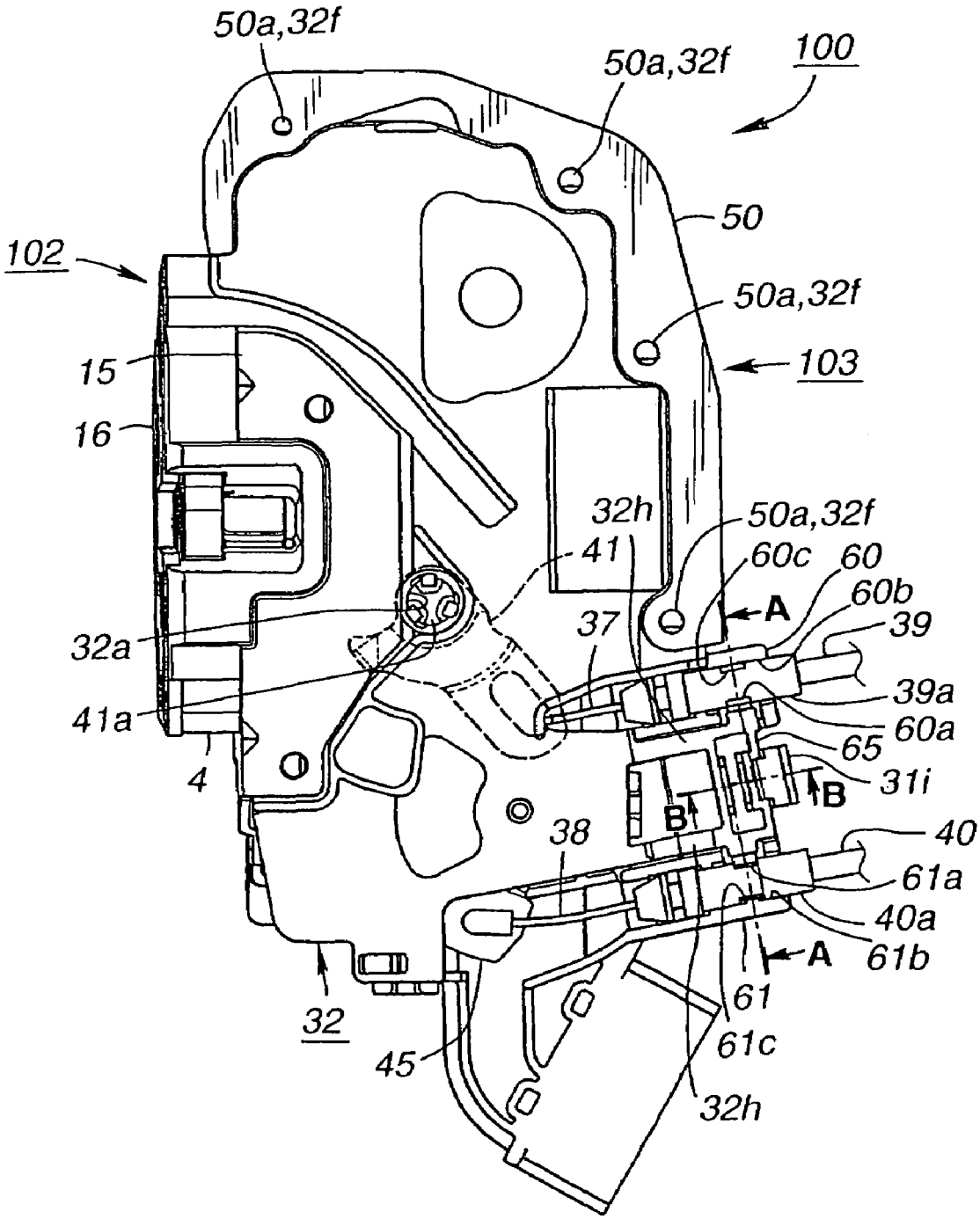
FIG. 6 is a left side view of the door latch device of the first embodiment, that is taken from the direction of the arrow "VI" of FIG. 3.
Figure 7:
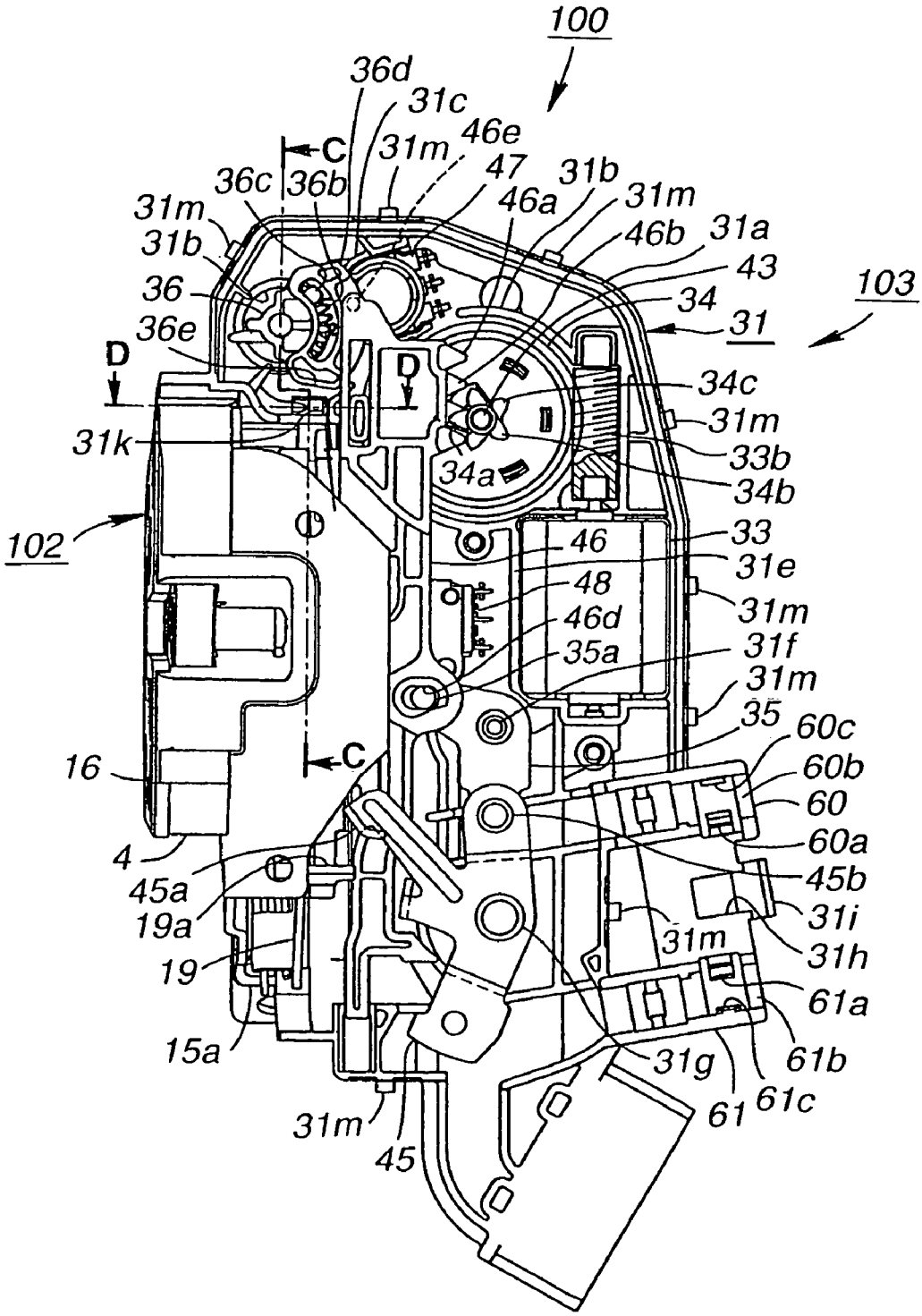
FIG. 7 is a left side view of the door latch device of the first embodiment with a cover removed.

As is seen from FIGS. 1 and 7, the knob lever 35 is pivotally held by a shaft portion 31*f* formed in the part containing recess 31*a* of the housing 31. The knob lever 35 is connected through a cable 37 (see FIG. 6) to the lock knob (not shown) mounted on the inside surface of the door. That is, in accordance with an operation of the lock knob, the knob lever 35 is pivoted between a locking position (as shown in FIGS. 7, 8 and 11) that corresponds to the locking condition of the locking/unlocking means and an unlocking position (as shown in FIG. 10) that is positioned away from the locking position of FIG. 11 by an angle of about 45 degrees in a counterclockwise direction.

Figure 8:
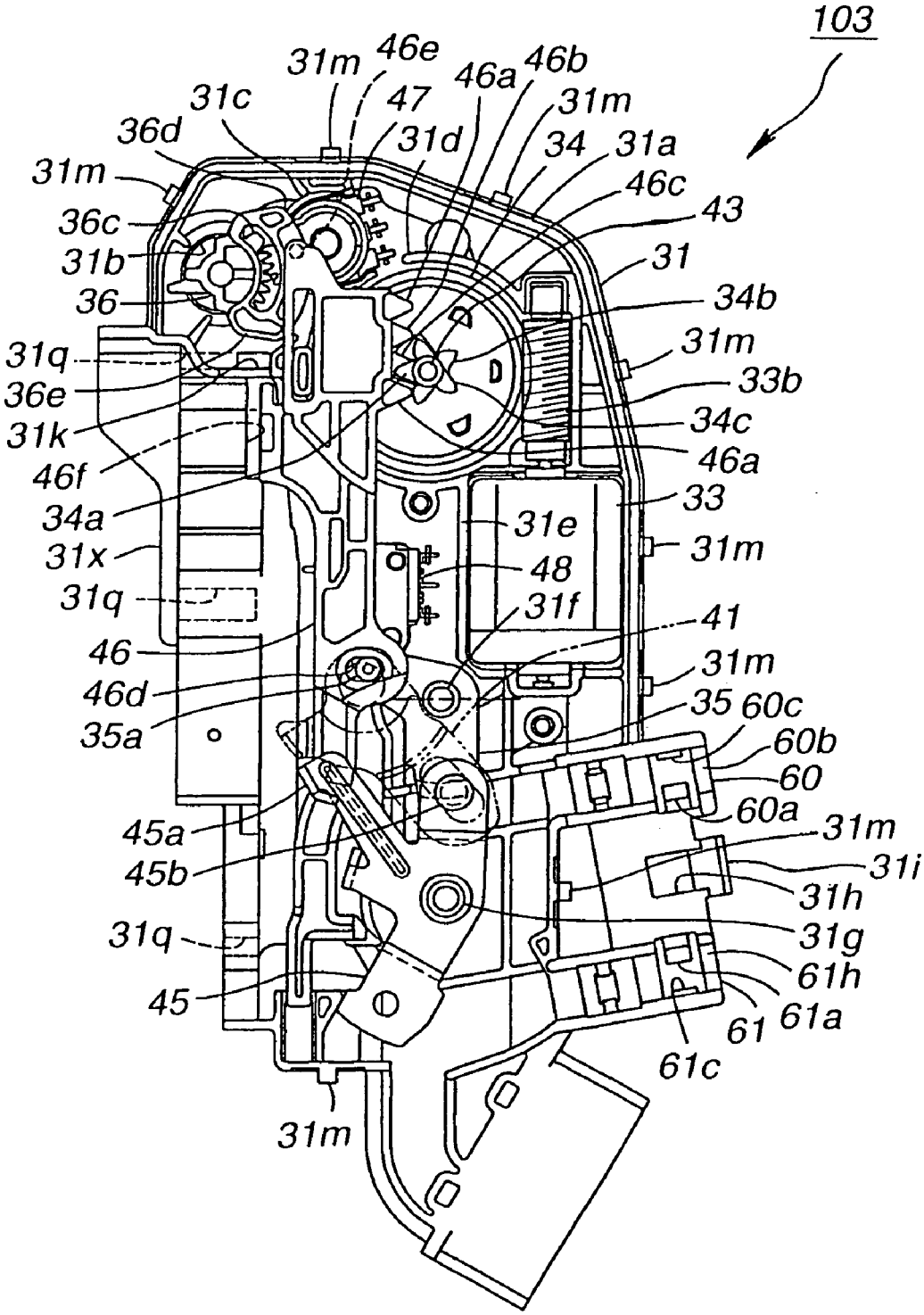
FIG. 8 is a left side view of an actuating assembly with a cover removed.
Figure 10:
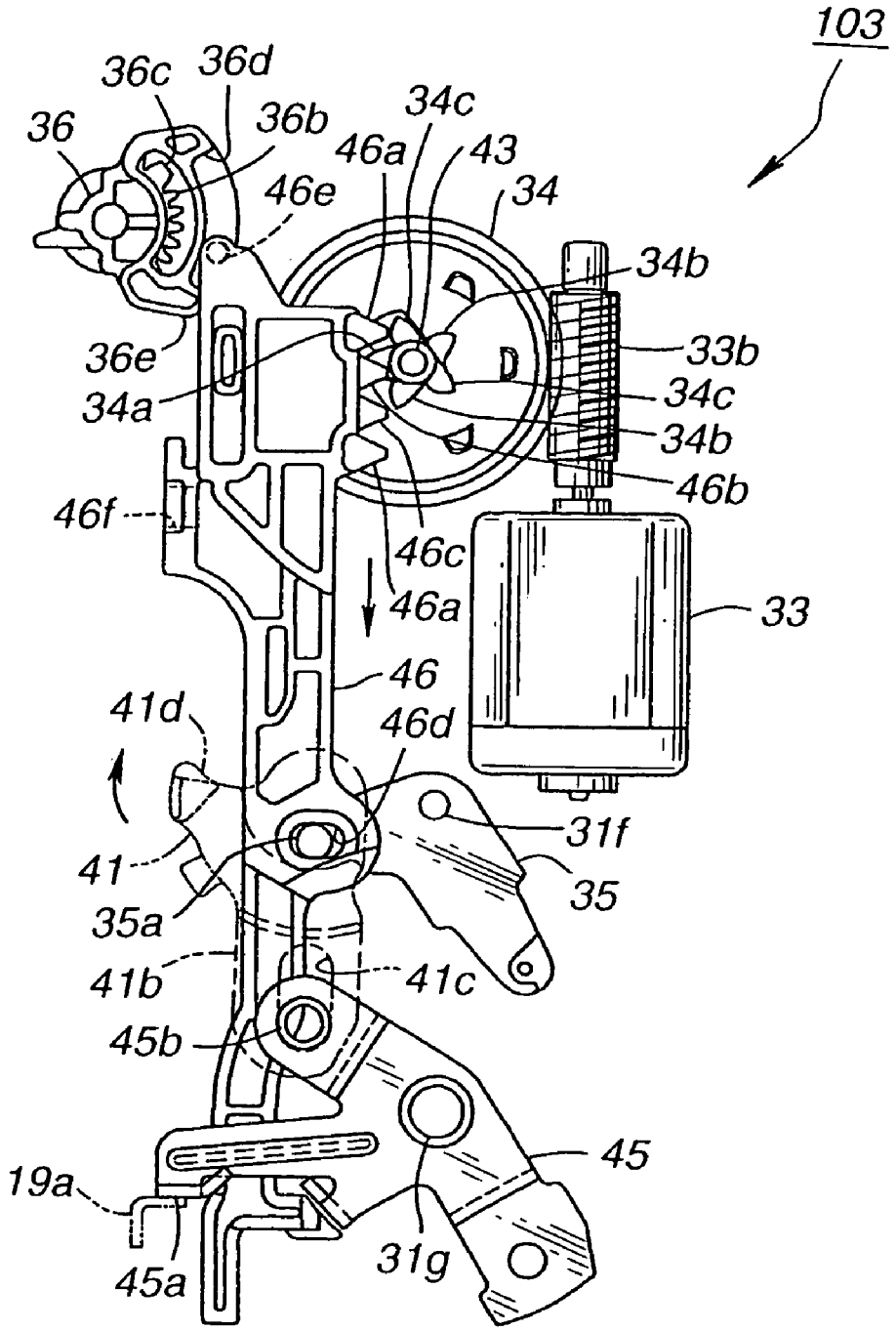
FIG. 10 is a left side view of an essential portion of the actuating assembly in an unlocked condition.
Figure 11:
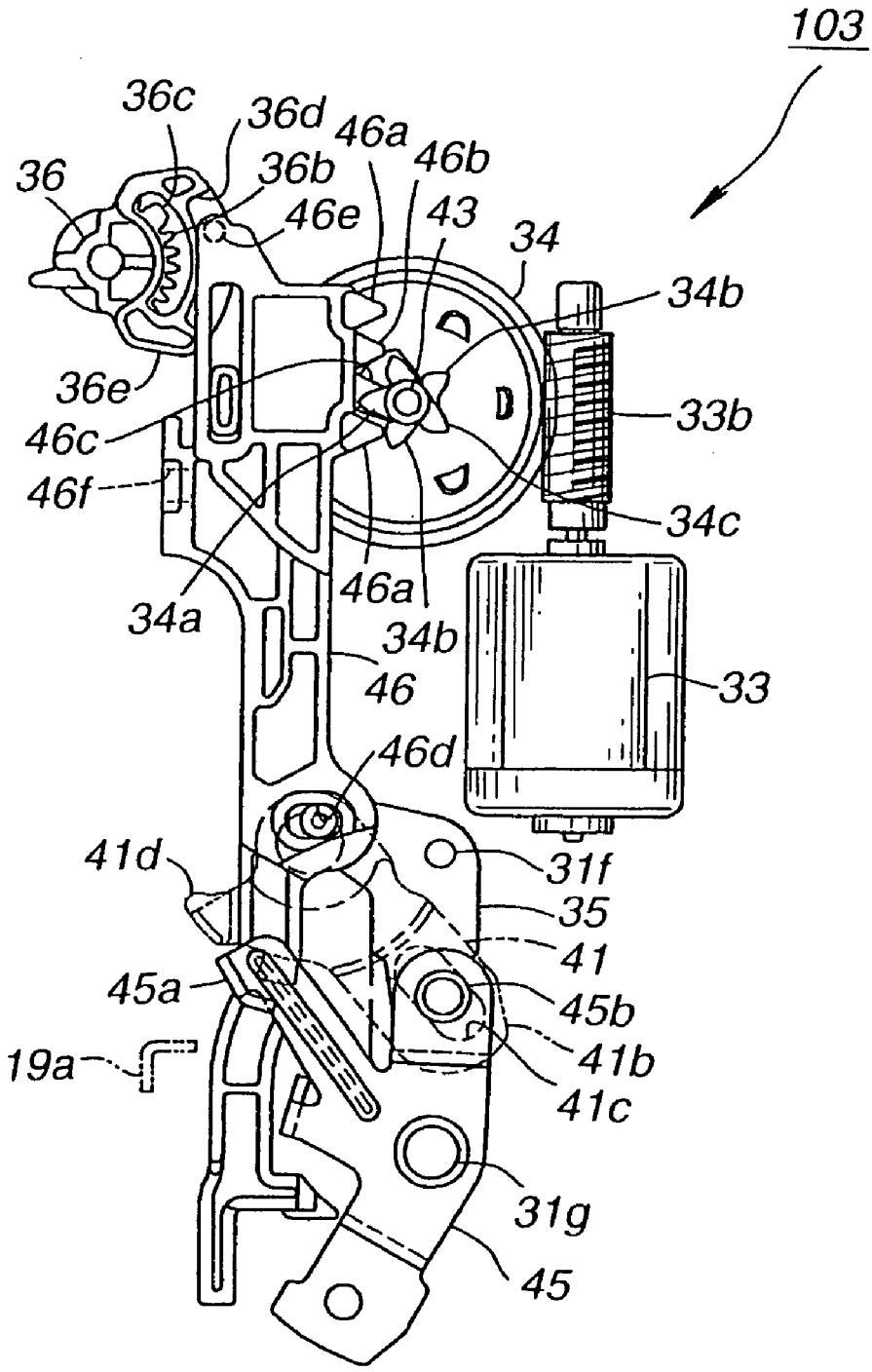
FIG. 11 is a view similar to FIG. 10, but showing the essential portion in a locked condition.

The transmission lever 46 is received in the part containing recess 31*a* of the housing 31 and vertically slidable between a locking position (as shown in FIGS. 7, 8 and 11) that corresponds to the locking condition of the locking/unlocking means and an unlocking portion (as shown in FIG. 10) that corresponds to the unlocking condition of the locking/unlocking means. As shown in FIG. 10, the transmission lever 46 is formed at its upper portion with an opening 46*f* into which the above-mentioned projection 17*b* of the locking/unlocking lever 17 is inserted to provide a pivotal connection therebetween. As shown in the same drawing, the transmission lever 46 is formed at its upper right side with teeth 46*a*, 46*b* and 46*c* which are meshed with teeth 34*a*, 34*b* and 34*c* formed on a hollow shaft portion of the worm wheel 34. Furthermore, the transmission lever 46 is formed at its middle portion with an opening 46*d* into which an end portion 35*a* of the knob lever 35 is inserted to provide a pivotal connection therebetween.

As is understood from the above description, in synchronization with the movement of the knob lever 35 to the locking or unlocking position that is induced by a locking/unlocking operation of the lock knob (not shown), the locking/unlocking means of the latch assembly 102 is switched via the transmission lever 46 to the locking condition or the unlocking condition.

As is seen from FIGS. 1, 6, 7 and 10, the inside lever 45 is pivotally held by a shaft portion 31*g* provided in the part containing recess 31*a* of the plastic housing 31. The inside lever 45 is connected through a cable 38 (see FIG. 6) to the inside door handle (not shown) that is mounted on the inside surface of the door. That is, when the inside door handle is manipulated for the purpose of opening the door, the inside lever 45 is turned about the shaft portion 31*g* in a counterclockwise direction in FIG. 7.

As is seen from FIG. 7, the electric motor 33 is neatly and tightly received in a motor receiving recess 31*e* provided in the part containing recess 31*a* of the housing 31. Although not shown in the drawings, upon manipulation of a remote control switch and the like, the motor 33 is energized to run in a desired direction.

The worm wheel 34 is received in a worm wheel receiving recess 31*d* formed near the motor receiving recess 31*e* and rotatably held by a shaft 43 provided in the worm wheel receiving recess 31*d*. As has been mentioned hereinabove, the teeth 34*a*, 34*b* and 34*c* formed on the hollow shaft portion of the worm wheel 34 are meshed with the teeth 46*a*, 46*b* and 46*c* of the transmission lever 46. Thus, when, upon rotation of the motor 33, the worm wheel 34 is turned in a counterclockwise direction in FIG. 7, the transmission lever 46 is moved downward, and when the worm wheel 34 is turned in a clockwise direction, the transmission lever 46 is moved upward, resulting in that the locking/unlocking means is switched through the transmission lever 46 to the unlocking condition or the locking condition. When the transmission lever 46 is moved to the lower or upper predetermined position, a limit switch 48 stops the energization of the motor 33. Upon this, the worm wheel 34 is returned to its neutral position due to the biasing force of a biasing coil spring 44 (see FIGS. 1 and 18). The limit switch 48 is received in the part containing recess 31*a* of the housing 31.

As is seen from FIGS. 1, 7, 12 and 17, the key lever 36 pivotally received in a cylindrical key lever receiving bore 31*b* formed in the housing 31. The key lever 36 has a shaft portion 36*a* that projects outward through a through bore 31*j* (see FIG. 17) formed in an end portion of the key lever receiving bore 31*b*. As is seen from FIGS. 12 and 17, to the projected end of the shaft portion 36*a*, there is secured a connecting lever 36*f* that is connected to the key cylinder (not shown) mounted on the outer surface side of the door.

As is seen from FIG. 7, the key lever 36 is formed thereabout with teeth 36*b*. As shown, one of the teeth 36*b* that is positioned at the uppermost part has a larger size, that is denoted by numeral 36*c*. As will be described hereinafter, the teeth 36*b* and the larger tooth 36*c* are arranged to face the rotary switch 47.

Figure 12:
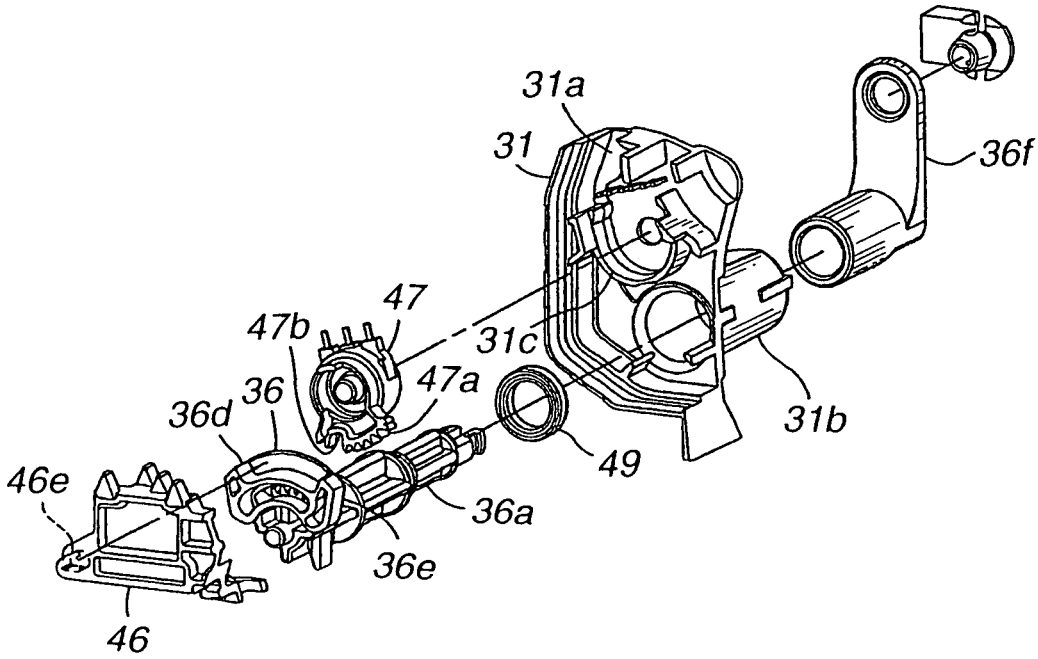
FIG. 12 is an exploded view of the essential portion.
Figure 13:
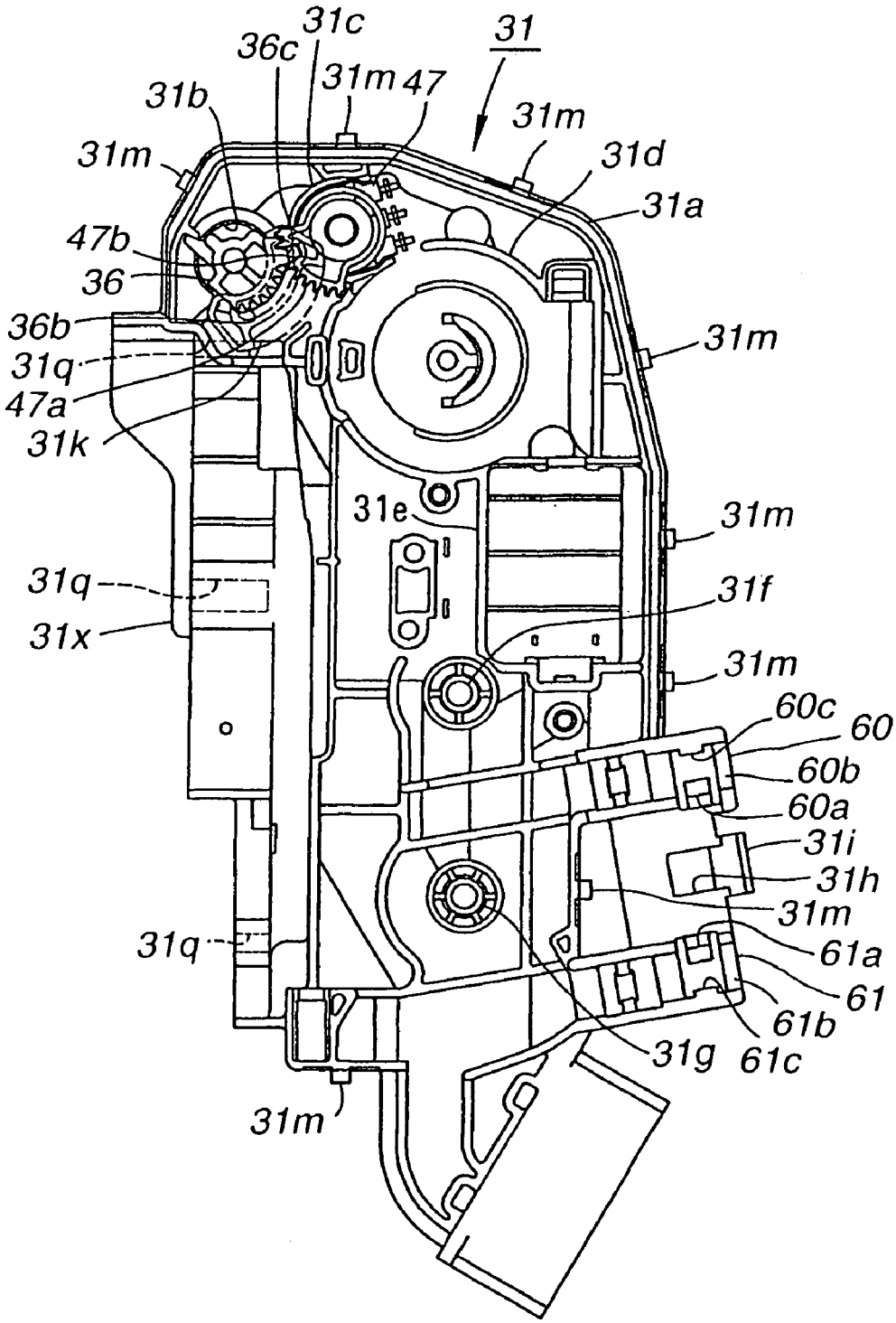
FIG. 13 is a left side view of a housing.
Figure 14:
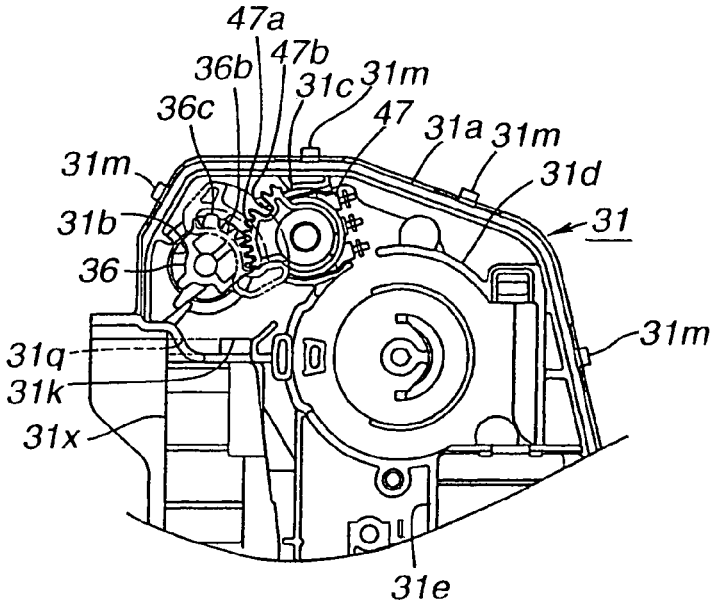
FIG. 14 is a left side view of an essential portion of the housing.
Figure 15:
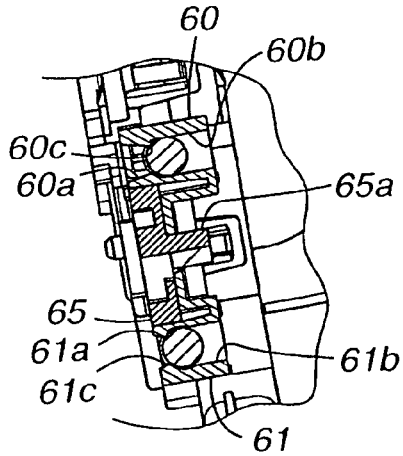
FIG. 15 is a vertically sectional view taken along the line "A-A" of FIG. 6.
Figure 16:
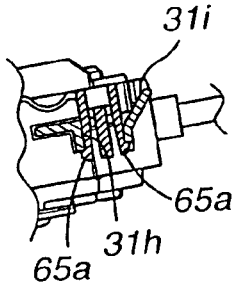
FIG. 16 is a horizontally sectional view taken along the line "B-B" of FIG. 6.
Figure 17:
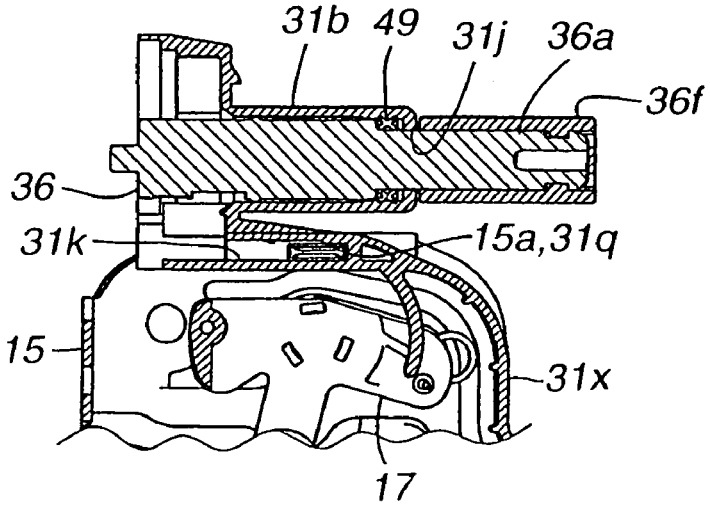
FIG. 17 is a vertically sectional view taken along the line "C-C" of FIG. 7.
Figure 18:
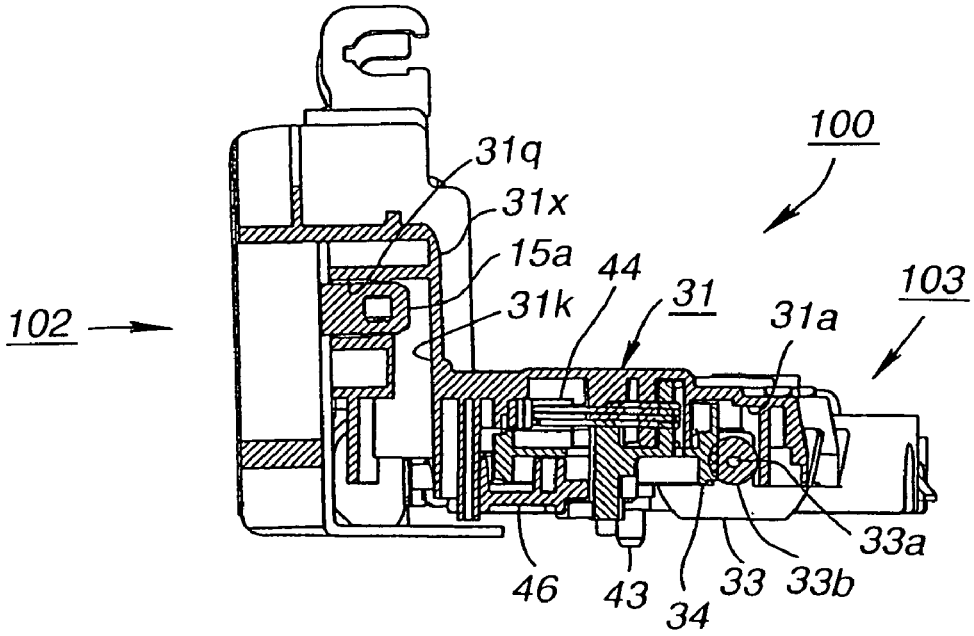
FIG. 18 is a horizontally sectional view taken along the line "D-D" of FIG. 7.

As will be seen from FIGS. 12 and 17, between an outer surface of the shaft portion 36*a* of the key lever 36 and an inner surface of the key lever receiving bore 31*b*, there is arranged an annular sealing member 49. With this sealing member 49, undesired phenomenon wherein rain water entering the interior of the door enters the part containing recess 31*a* through the key lever receiving bore 31*b* is suppressed.

When, with the locking/unlocking means assuming the locking condition, the key cylinder is turned by a key (not shown) for the purpose of unlocking the door, the key lever 36 (see FIGS. 7 and 8) is turned in a clockwise direction by a certain angle from its neutral position of the drawings, so that an upper pawl portion 36*d* (see FIG. 10) formed on the key lever 36 is moved down and brought into contact with a projection 46*e* of the transmission lever 46. With this, the transmission lever 46 is moved from the locking position to the unlocking position thereby to induce the unlocking condition of the locking/unlocking means. While, when, with the locking/unlocking means assuming the unlocking condition, the key cylinder is turned in a reversed direction by the key for the purpose of locking the door, the key lever 36 is turned in a counterclockwise direction by a certain angle from the neutral position as shown in FIG. 10, so that a lower pawl portion 36*e* formed on the key lever 36 is moved up and brought into contact with the projection 46*e* of the transmission lever 46. With this, the transmission lever 46 is moved from the unlocking position to the locking position thereby to induce the locking condition of the locking/unlocking means.

As is seen from FIGS. 1, 7, 8 and 12, the rotary switch 47 is snugly and tightly received in a switch receiving wall portion 31*c* positioned near the key lever receiving bore 31*b*. As is best shown in FIG. 12, the rotary switch 47 is formed, at a part facing the teeth 36*b* of the key lever 36, with teeth 47*a* that are meshed with the teeth 36*b* of the key lever 36. As shown, in the toothed part of the rotary switch 47, there is formed a larger notch 47*b* with which the above-mentioned larger tooth 36*c* of the key lever 36 is engaged. More specifically, the engagement between the larger notch 47*b* and the larger tooth 36*c* is established only when the rotary switch 47 and the key lever 36 take proper positions relative to each other upon assembly.

As is seen from FIGS. 1, 2, 5, 6, 7, 8, 13 and 15, at a lower portion of the part containing recess 31*a* of the housing 31, there are formed two tube fixing portions 60 and 61 that are used for fixing ends 39*a* and 40*a* of two tubes 39 and 40 (see FIG. 6) through which the above-mentioned cables 37 and 38 pass.

As is seen from FIGS. 6 and 7, particularly FIG. 7, the two tube fixing portions 60 and 61 spaced from each other by a given distance. As shown, at mutually facing wall portions of these two fixing portions 60 and 61, there are provided respective first pawl portions 60*a* and 61*a* that project into respective groove portions 60*b* and 61*b* of the fixing portions 60 and 61. These first pawl portions 60*a* and 61*a* are resiliently flexible. In the groove portions 60*b* and 61*b*, there are formed respective second pawl portions 60*c* and 61*c* at positions facing the first pawl portions 60*a* and 61*a*. The second pawl portions 60*c* and 61*c* are relatively rigid as compared with the first pawl portions 60*a* and 61*a*.

As is seen from FIG. 7, between the two fixing portions 60 and 61 of the housing 31, there is formed a generally rectangular opening 31*h*. As is seen from FIG. 16, the opening 31*h* is formed at its front end portion with an inclined lip portion 31*i* that projects toward the inside surface of the door.

As is seen from FIGS. 7, 8, 13, 14 and 17, below the key lever receiving bore 31*b* of the housing 31, there is defined a rain water guide passage 31*k* through which rain water is guided toward the cover portion 31*x* (see FIG. 8) and discharged to the outside of the door latch device.

Due to provision of the rain water guide passage 31*k*, the various electric elements, such as the motor 33, the rotary switch 47, the limit switch 48 and the like, are protected from water (viz., rain water) that might enter the key lever receiving bore 31*b* from the through bore 31*j* irrespective of provision of the sealing member 49.

As is seen from FIGS. 1, 8, 13, 14 and 18, the cover portion 31*x* of the housing 31 is formed with three mating openings 31*q* with which three pawl portions 15*a* provided by the metallic base plate 15 are respectively engaged. That is, by properly engaging the pawl portions 15*a* with the mating openings 31*q*, the housing 31 becomes fixed to a front side of the latch assembly 102. It is to be noted that the uppermost one of the three mating openings 31*q*, that is positioned near the key lever receiving bore 31*b*, is communicated with the water guide passage 31*k* as is seen from FIG. 8. Accordingly, the water led to the water guide passage 31*k* is charged toward the cover portion 31*x* of the housing 31 from the uppermost mating opening 31*q*.

Figure 9:
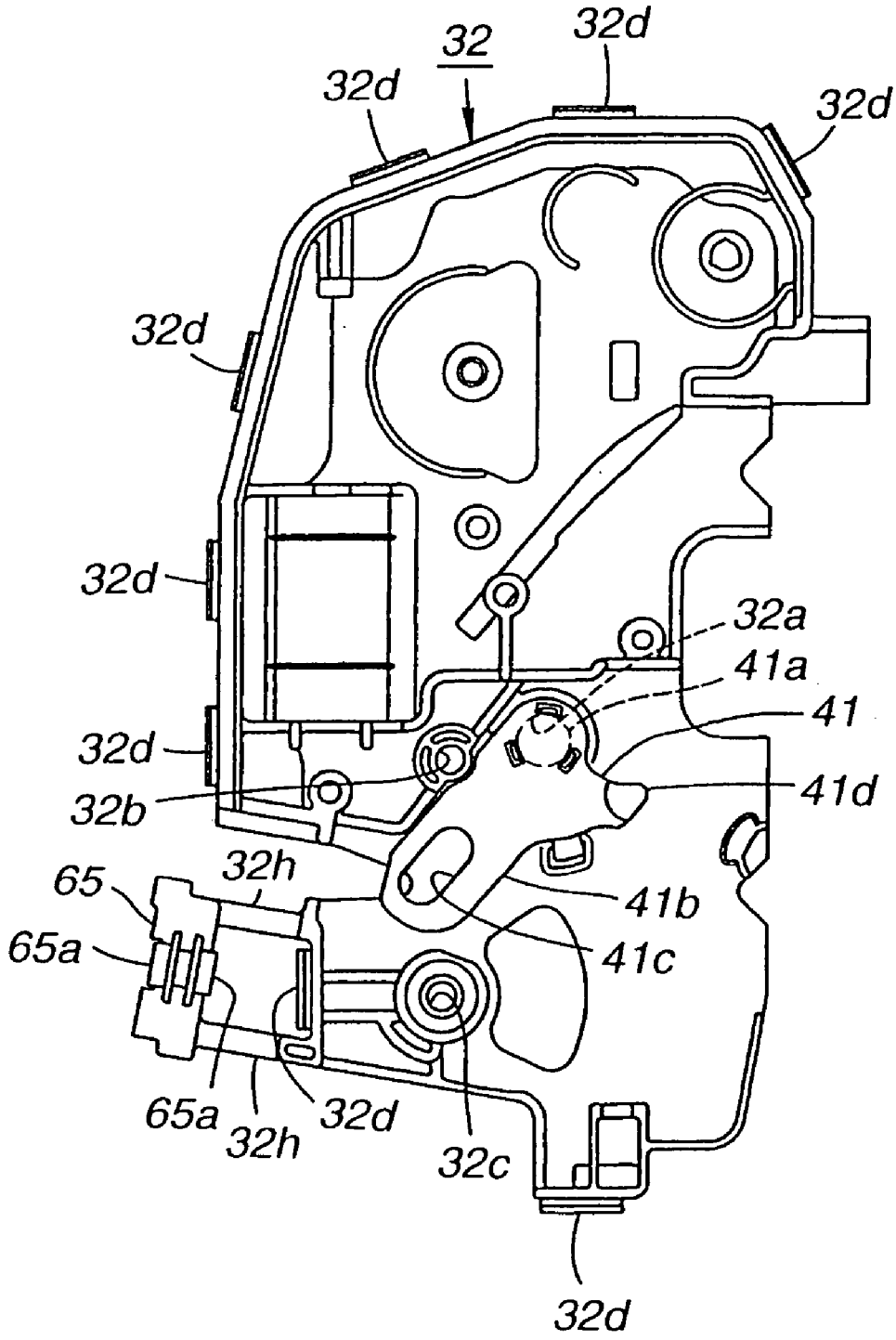
FIG. 9 is an inside view of the cover.

As is best seen from FIG. 9, the plastic cover 32 is formed at a peripheral portion thereof with a plurality of catching lugs 32*a*. As is understood from FIG. 8, in assembly, such catching lugs 32*d* are resiliently engaged with a plurality of projections 31*m* formed on a peripheral portion of the housing 31. With this, upon assembly, the plastic cover 32 is fixed to the housing 31 in a manner to cover the part containing recess 31*a*.

As is seen from FIG. 9, in an inside surface of the cover 32 (viz., the surface that faces the housing 31), there is provided a pivot bore 32*a* that serves as a common pivot part.

To this pivot bore 32*a*, there is pivotally connected the override lever 41 that is a selected element. Furthermore, to this pivot bore 32*a*, there can be also pivotally connected the child proof lever 70 in case wherein the door latch device is of the child proof type. That is, the override lever 41 and the child proof lever 70, which are both selected elements, are selectively connected to the pivot bore 32*a*. Of course, in place of the pivot bore 32*a*, a pivot shaft portion may be used. With this novel construction, the housing is capable of being selectively interchangeably used with both the override function unit or the childproof function unit, depending on the desired function.

As is seen from FIG. 9, the override lever 41 is integrally formed with a shaft portion 41*a* that is rotatably received in the pivot bore 32*a*. With this, override lever 41 is pivotally supported by the inside surface of the cover 32. Upon fixing of the cover 32 to the housing 31, the override lever 41 becomes aligned with both the transmission lever 46 and the knob lever 35, and a projection 45*b* formed on the inside lever 45 becomes engaged with an elongate opening 41*c* formed in an arm portion 41*b* of the override lever 41, as will be understood from FIG. 1.

When, upon manipulation of the inside door handle, the inside lever 45 is turned from the stand-by position (viz., the is position as shown in FIGS. 7, 8 and 11) to the unlocking position (viz., the position as shown in FIG. 10), the override lever 41 is turned from a stand-by position as shown by the two-dot chain line in FIG. 11 to an unlocking position as shown by the two-dot chain line in FIG. 10, so that an actuating portion 41*d* of the override lever 41 is brought into contact with a second engaging portion 11*b* (see FIG. 21) of the open lever 11 thereby turning the open lever 11 toward the unlocking position. With this, irrespective of the condition of the locking/unlocking means, the engaged condition of the latch unit 5 can be released and thus the door can be opened. At the same time, an actuating portion 45*a* formed on an end of the inside lever 45 (see FIG. 10) is brought into contact with a bent portion 19*a* formed on an end of the outside lever 19, thereby turning the outside lever 19 toward the unlocking position.

As is seen from FIG. 9, on the inside surface of the cover 32, there are formed two annular portions 32*b* and 32*c* that are snugly mated with ends of the shaft portions 31*f* and 31*g* of the housing 31. With such mating, the knob lever 35 (see FIG. 10) and the inside lever 45 can be smoothly held by the shaft portions 31*f* and 31*g* respectively.

As is seen from FIGS. 2 and 9, at a lower portion of the cover 32, there are provided upper and lower connecting arms 32*h*. As is best seen from FIG. 2, at leading ends of the connecting arms 32*h*, there is provided a holding portion 65 by which the ends 39*a* and 40*a* of the two tubes 39 and 40 are tightly connected to the tube fixing portions 60 and 61 of the housing 31. As is seen from FIG. 9, the holding portion 65 is formed with two resiliently deformable pawls 65*a* that are engageable with the generally rectangular opening 31*h* of the housing 31.

When it is intended to couple the cover 32 with the housing 31, the two pawls 65*a* of the holding portion 65 are brought into engagement with the rectangular opening 31*h*. With this, the holding portion 65 is stably held between the two tube fixing portions 60 and 61. As is seen from FIG. 15, both ends of the holding portion 65 are pressed against back sides of the first pawl portions 60*a* and 61*a* of the fixed portions 60 and 61, so that the first pawl portions 60*a* and 61*a* are pressed toward the interior of the groove portions 60*b* and 61*b*. Thus, the leading ends of the resilient first pawl portions 60*a* and 61*a* are strongly pressed against the fixing ends 39*a* and 40*a* of the two tubes 39 and 40 that are received in the groove portions 60*b* and 61*b*, and thus, the fixed ends 39*a* and 40*a* are tightly fixed in the groove portions 60*b* and 61*b*. Upon engagement of the two resilient pawls 65*a* with the rectangular opening 31*h*, the leading end of the pawls 65*a* are brought into contact with the inclined lip portion 31*i* of the housing 31 to be guided toward the opening 31*h*. Thus, the engagement of the pawls 65*a* with the opening 31*h* is easily and assuredly carried out.

As is seen from FIGS. 1, 2, 3, 5 and 6, particularly FIG. 2, from upper surfaces of the housing 31 and the cover 32 to the two tube fixing portions 60 and 61, there extends a generally J-shaped plastic top cover 50 for suppressing rain water invasion into the part containing recess 31*a* of the housing 31. As is seen from FIG. 1, the top cover 50 is formed with a plurality of coupling openings 50*a* with which a plurality of projections 31*n* and 32*f* formed on the housing 31 and the cover 32 are engaged, so that the top cover 50 are fixed to both the housing 31 and the cover 32 in such a manner that opposed walls of the top cover 50 receive therebetween peripheral portions of both the housing 31 and the cover 32.

In the following, a child proof type door latch device 200 which is a second embodiment of the present invention will be described with reference to FIGS. 25 to 28.

Since a latch assembly employed in the door latch device 200 of the second embodiment is the same as the latch assembly 102 employed in the above-mentioned override type door latch device 100 of the first embodiment, explanation of the latch assembly will be omitted from the following description. Furthermore, since, in the second embodiment 200, a housing (31), cover (32) and basic elements mounted in the housing (31) are substantially same as those employed in the first embodiment 100, detailed description of such parts will be omitted from the following. That is, in the following, only parts or portions that are different from those of the first embodiment 100 will be described.

Figure 25:
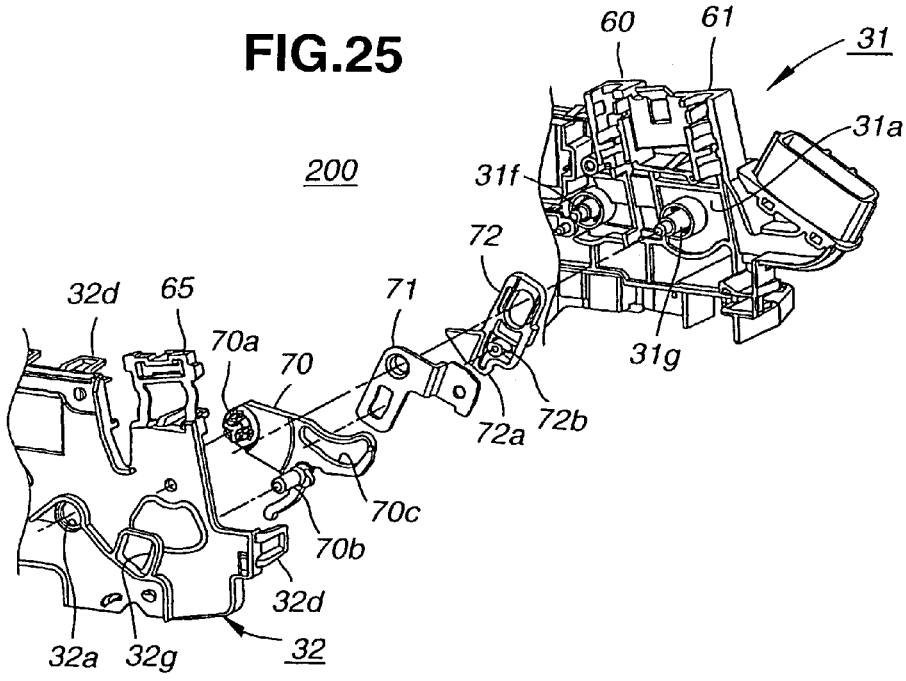
FIG. 25 is an exploded view of an essential portion of a child proof type door latch device which is a second embodiment of the present invention.

As is seen from FIG. 25, in the child proof type door latch device 200 of the second embodiment of the present invention, the child proof lever 70 is used in place of the override lever 41 used in the first embodiment 100. That is, as is seen from the drawing, the child proof lever 70 is pivotally connected to the pivot bore 32*a*. Furthermore, in place of the inside lever 45 in the first embodiment 100, a child proof inside lever 71 is used which is pivotally connected to the shaft portion 31*g* of the housing 31. Furthermore, a switch lever 72 is employed which is slidably held on the child proof inside lever 71.

Figure 25A:
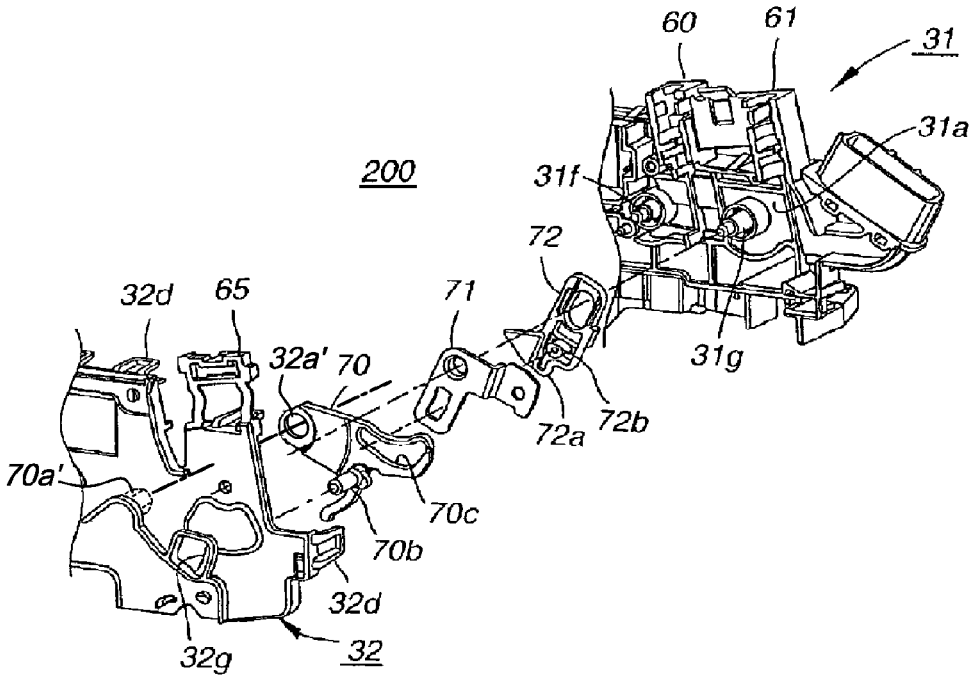
FIG. 25A is an exploded view of an essential portion of a child proof type door latch device which is an alternative arrangement of the second embodiment illustrated in FIG. 25.
Figure 26:
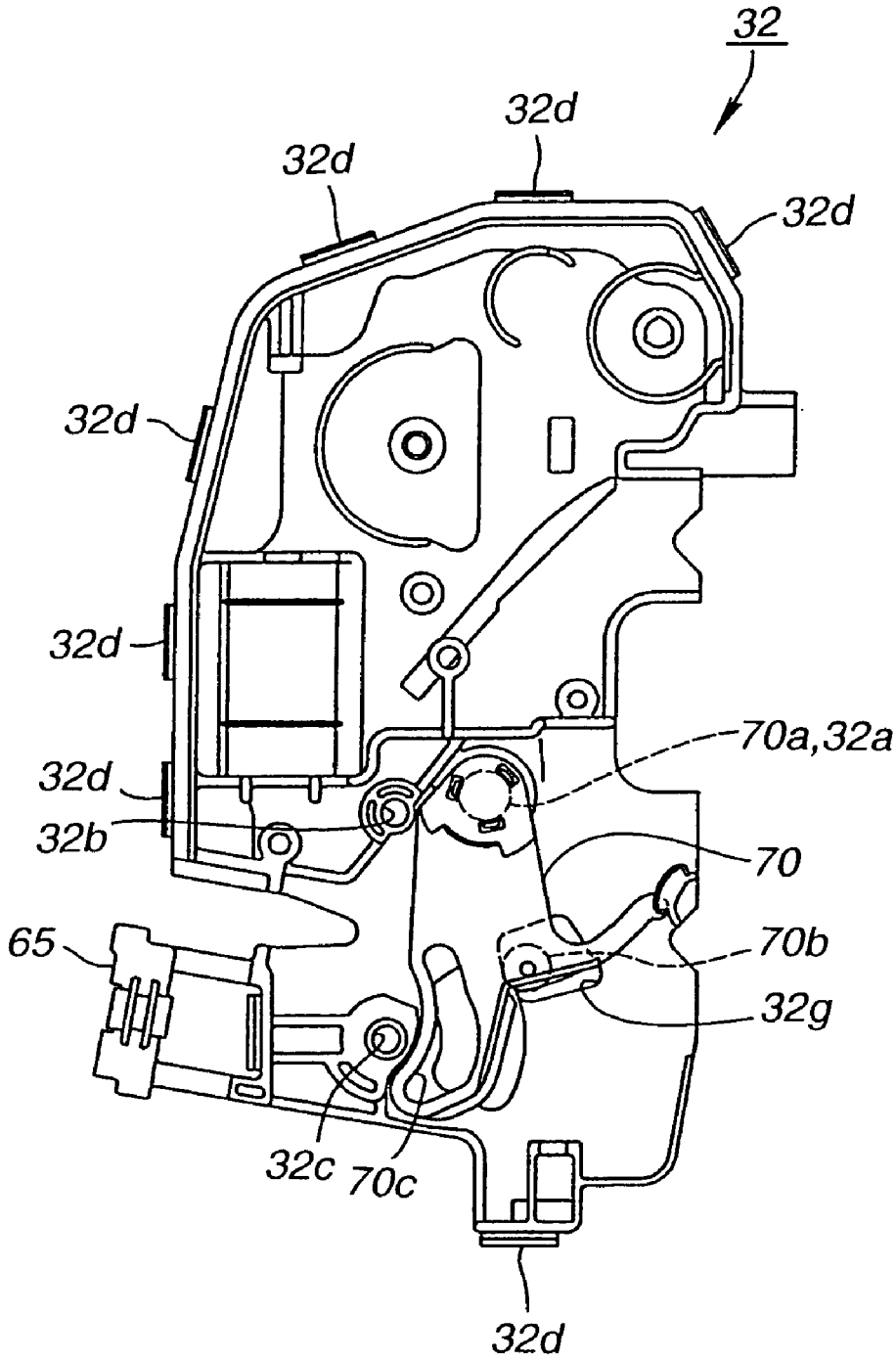
FIG. 26 is a right side view of a cover that is used in the child proof type door latch device.

As is seen from FIG. 25, the child proof lever 70 has a shaft portion 70*a* rotatably received in the pivot bore 32*a* of the cover 32, and has a pin portion 70*b* that projects outward through an opening 32*g* formed in the cover 32. FIG. 25A illustrates a reversal of parts for the cover 32 and child proof lever 70, wherein the cover 32 has a shaft portion 70*a*' and the child proof lever 70 has a pivot bore 32*a*' for rotatably receiving the shaft portion 70*a*' .

Figure 27:
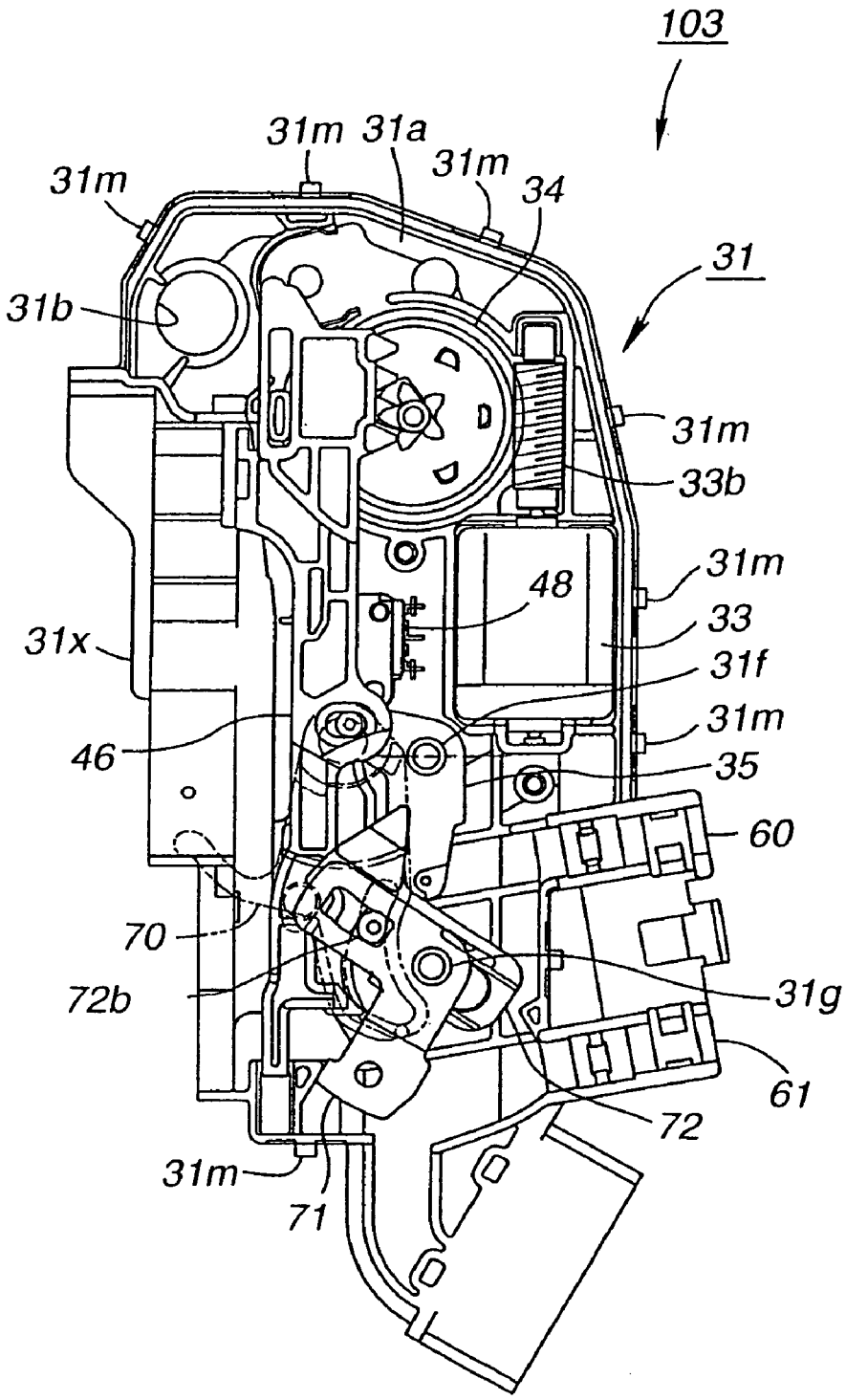
FIG. 27 is a left side view of an actuating assembly of the child proof type door latch device, with the cover removed.
Figure 28:
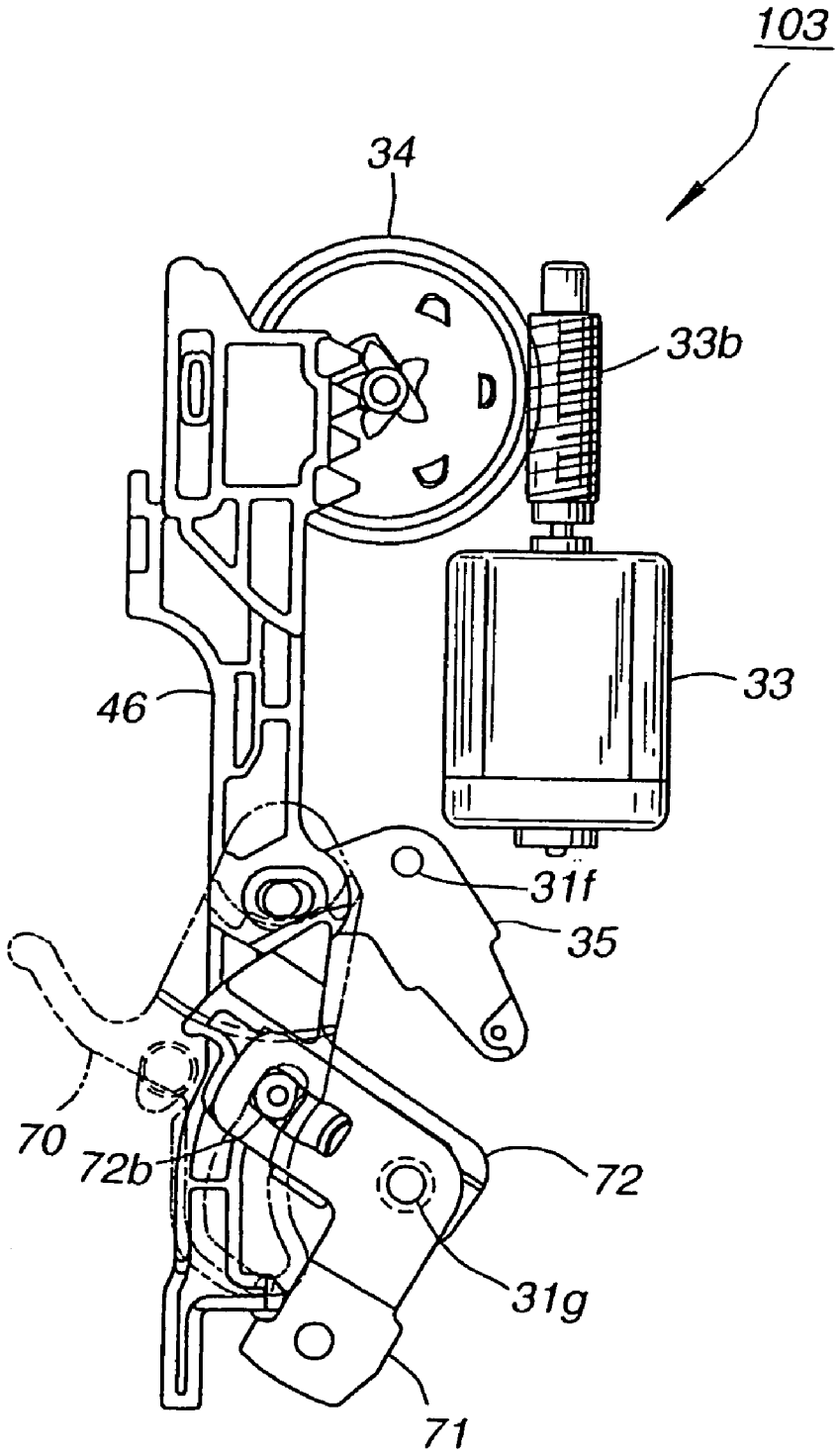
FIG. 28 is a left side view of an essential portion of the actuating assembly of the child proof type door latch device.

That is, when the pin portion 70*b* is actuated, the child proof lever 70 is pivoted between a locking position as shown by the two-dot chain line in FIG. 27 and an unlocking position as shown by the two-dot chain line in FIG. 28.

When the cover 32 is properly fixed to the housing 31, an elongate slot 70*c* formed in the child proof lever 70 puts thereinto a projection 72*b* formed on the switch lever 72. Thus, in accordance with a pivotal movement of the child proof lever 70, the switch lever 72 is moved between an unlocking position as shown in FIG. 28 wherein an actuating end 72*a* of the switch lever 72 is contactable with the bent portion 19*a* of the outside lever 19 (see FIG. 10) and a locking position as shown in FIG. 27 wherein the actuating end 72*a* is not contactable with the bent portion 19*a* (see FIG. 11).

When, with the child proof lever 70 and the switch lever 72 assuming their unlocking positions and with the locking/unlocking means assuming its unlocking condition, the inside door handle is manipulated, the child proof inside lever 71 is operated to carry out a canceling operation. That is, upon this, the switch lever 72 and the child proof inside lever 71 are operated to carry out their canceling operation thereby to cancel the engaged condition of the latch unit 5.

While, when, with the child proof lever 70 and the switch lever 72 assuming their locking positions, the inside door handle is manipulated, the switch lever 72 strikes air against the bent portion 19*a* of the outside lever 19 irrespective of the condition of the locking/unlocking means. Thus, in this case, the outside lever 19 can not be turned toward the unlocking position, and thus, the engaged condition of the latch unit 5 can not be cancelled.

In general, the child proof type door latch device is applied to rear doors that are not provided with a key cylinder. Thus, in this second embodiment 200, there are no members that correspond to the key lever (36) and the rotary switch (47) that are used in the above-mentioned first embodiment 100. Accordingly, in this second embodiment 200, the key lever receiving bore 31*b* (see FIG. 27) and the through bore 31*j* of the housing 31 are inoperative, that is, plugged with a plastic screen. Plugging the through bore 31*j* is easily achieved by putting a suitable insert into a cavity of a die assembly in the injection molding of the housing 31.

The entire contents of Japanese Patent Application 2004-218567 filed Jul. 27, 2004 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. An automotive door latch device comprising:

a striker fixed to a body of the vehicle;

a latch assembly mounted to a door of the vehicle, the latch assembly including a latch means that is engageable with the striker and a locking/unlocking means that causes the latch means to switch between an unlocked condition wherein an engaged condition of the latch means is unlocked and a locked condition wherein the engaged condition of the latch means is locked; and an actuating assembly connected to the latch assembly to actuate the latch means and the locking/unlocking means, wherein the actuating assembly comprises:

a housing that is selectively interchangeably used with both an override function unit and a child proof function unit, the override function unit having a function wherein a manipulation of an inside door handle induces cancellation of the engaged condition of the latch means irrespective of the condition of the locking/unlocking means, the child proof function unit having a function wherein the manipulation of the inside door handle is made inoperative irrespective of the condition of the locking/unlocking means, thereby to make the cancellation of the engaged condition of the latch means impossible; and a cover that is connected to the housing and holds thereon, having a common pivot support portion comprising a common shaft that is orthogonal to a main surface of the cover, or a common pivot bore wherein the common pivot support portion serves as a common pivot part for both the override function unit and the child proof function unit, depending on which unit is selected, a selected element that is exclusively used in either one of the override function unit or the child proof function unit, said selected element being rotatable about said common pivot support portion and in a plane parallel to said main surface of the cover, wherein, upon coupling of the cover with the housing, the selected element is aligned with both a transmission lever and a knob lever installed in the housing, wherein the transmission lever transmits the movement of the knob lever to the locking/unlocking means.

2. An automotive door latch device as claimed in claim 1, in which the cover of the actuating assembly is provided with said pivot support portion that is constructed to pivotally support the selected element.

3. An automotive door latch device as claimed in claim 1, in which the selected element of the override function unit is an override lever that is turned in synchronization with an operation of the inside door handle, the override lever canceling the engaged condition of the latch means when turned in a given direction by a given angle.

4. An automotive door latch device as claimed in claim 1, in which the selected element of the child proof function unit is a child proof lever that makes movement of the transmission lever, the knob lever and an inside lever based on an operation of the inside door handle inoperative thereby to make cancellation of the engaged condition of the latch means impossible.

5. An automotive door latch device as claimed in claim 1, in which the cover of the actuating assembly is formed with the common pivot bore in which a shaft portion of the selected element is rotatably received.

6. An automotive door latch device as claimed in claim 1, in which the housing and the cover of the actuating assembly are constructed of a plastic.

* * * * *